US011497977B2

(12) United States Patent
Sudeith et al.

(10) Patent No.: US 11,497,977 B2
(45) **Date of Patent: *Nov. 15, 2022**

(54) MULTI-PURPOSE ADJUSTABLE-INCLINE CLIMBING WALL

(71) Applicant: Everlast Climbing Industries, Inc., Minneapolis, MN (US)

(72) Inventors: Timothy Shawn Sudeith, Edina, MN (US); Sarah Mae Howard, Lakeville, MN (US); Benjamin Tiffin, Missoula, MT (US); Joel Greenblatt, Wauwatosa, WI (US); Joseph Sweeney, Minneapolis, MN (US); Aaron Jon Baumgartner, Savage, MN (US); Justin Lee, Eagan, MN (US)

(73) Assignee: EVERLAST CLIMBING INDUSTRIES, INC., Crystal, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/783,825

(22) Filed: Feb. 6, 2020

(65) Prior Publication Data

US 2020/0171369 A1 Jun. 4, 2020

Related U.S. Application Data

(63) Continuation-in-part of application No. 16/028,931, filed on Jul. 6, 2018, now Pat. No. 10,918,925.
(Continued)

(51) Int. Cl.
*A63B 69/00* (2006.01)

(52) U.S. Cl.
CPC ..... *A63B 69/0048* (2013.01)

(58) Field of Classification Search
CPC ..... A63B 69/0048; A63B 23/12; A63B 23/03541; A63B 21/0552; A63B 21/0442;
(Continued)

(56) References Cited

U.S. PATENT DOCUMENTS 6,231,482 B1 5/2001 Thompson
6,860,836 B1 3/2005 Wu
(Continued)

FOREIGN PATENT DOCUMENTS

BE 905390 12/1986
DE 102005063225 A1 * 6/2007 ..... A63B 69/0048
(Continued)

OTHER PUBLICATIONS

"Removable Climbing Hold Bracket (No. Hold)," Atomik Climbing Holds, dated May 5, 2016, 1 page, retrieved from the Internet: https://www.atomikclimbingholds.com/removable-climbing-hold (Year: 2016).

(Continued)

*Primary Examiner* — Garrett K Atkinson
*Assistant Examiner* — Kathleen M Fisk
(74) *Attorney, Agent, or Firm* — McAndrews, Held & Malloy, Ltd.

(57) ABSTRACT

Embodiments of the present invention are directed to an adjustable-incline climbing wall. The climbing wall includes one or more climbing panels supported by a frame and a system for adjusting the incline of the frame to provide a climbing wall of a desired incline. The incline of the climbing wall may be adjusted by activating an actuator, which extends the frame a distance from a support wall, tilting the climbing wall to a desired incline. Further, by providing a plurality of attachment points between the actuator and the frame (and/or between the actuator and a support), the adjustable-incline climbing wall may be pro-
(Continued)

vided with a wider range of incline angles, as well as increased control over those angles.

24 Claims, 18 Drawing Sheets

Related U.S. Application Data

(60) Provisional application No. 62/529,315, filed on Jul. 6, 2017.

(58) Field of Classification Search
CPC ..... A63B 21/169; A63B 2225/74; A63B 2071/009; A63B 71/0622; A63B 2071/0625; A63B 2071/0675; A63B 71/0686; A63B 24/0075; A63B 24/00; A63B 2225/50; A63B 2225/09; A63B 9/00; A63B 2009/006
See application file for complete search history.

(56) References Cited

U.S. PATENT DOCUMENTS

| | | | | |
|---|---|---|---|---|
| 6,872,167 | B1 | 3/2005 | Meissner | |
| 7,195,582 | B2 | 3/2007 | Wu | |
| 7,686,739 | B2 | 3/2010 | Vanamo | |
| 7,727,118 | B1 | 6/2010 | McCall | |
| 7,762,928 | B2 | 7/2010 | Meissner | |
| 9,017,224 | B1 | 4/2015 | Singley | |
| 9,132,330 | B2 | 9/2015 | Brendle | |
| 2002/0169052 | A1 | 11/2002 | Godsey | |
| 2004/0229732 | A1 | 11/2004 | Wang | |
| 2008/0293547 | A1 | 11/2008 | Moy | |
| 2019/0009157 | A1* | 1/2019 | Sudeith | A63B 71/0054 |
| 2020/0023257 | A1* | 1/2020 | Speed | A63B 1/00 |

FOREIGN PATENT DOCUMENTS

| | | | | |
|---|---|---|---|---|
| DE | 202007014591 | | 3/2008 | |
| FR | 2682606 | A1 * | 4/1993 | A63B 69/0048 |

OTHER PUBLICATIONS

Vertical Solutions' (ATP) Adjustable Training Platform, by Vertical Solutions, May 9, 2018, 3 pages.

* cited by examiner

MULTI-PURPOSE ADJUSTABLE-INCLINE CLIMBING WALL

This application is a continuation-in-part of U.S. Non-Provisional patent application Ser. No. 16/028,931, filed on Jul. 6, 2018, which claims priority to U.S. Provisional Patent Application No. 62/529,315, filed on Jul. 6, 2017, the entirety of which is incorporated by reference herein.

SUMMARY OF THE INVENTION

Embodiments of the present disclosure are directed to a climbing wall configured to be moved between a substantially vertical orientation and an array of different angles, thereby providing a variety of inclined climbing experiences. Additionally, the climbing wall is configured so that it can be positioned relatively close to a support wall and stored in a substantially vertical orientation when not in use, thereby creating a relatively small footprint.

Embodiments of the adjustable-incline climbing wall include one or more climbing panels attached to and supported by a frame. The one or more climbing panels contain a plurality of climbing grips, thereby forming a climbing surface.

The climbing wall also includes a system for adjusting the incline of the climbing surface. The system includes at least a base unit and an actuator. The base unit supports the frame above the ground surface and connects to the support wall for stability. The base unit provides a stable supporting surface for the climbing wall throughout a range of incline angles. The base unit may be hingedly attached to the bottom section of the frame of the climbing wall. Alternatively, the base unit may comprise an additional fixed frame element that supports the wall frame in a raised position. In that embodiment, the fixed frame element may be hingedly attached to the bottom section of the climbing wall frame.

The actuator is configured to adjust the incline of the climbing wall so that the climbing surface may be positioned at substantially any angle of incline within a permitted range.

In some embodiments, the actuator may have a first end hingedly mounted to either the base or an actuator support frame and a second end hingedly mounted to the frame of the climbing wall. The actuator support frame may, for example, extend from the second end of the base unit. In this embodiment, the actuator may be configured to adjust the incline of the climbing surface by extending, which causes an upper portion of the frame (and hence the attached climbing surface) to lower in order to create a greater incline, or retracting, which causes an upper portion of the frame (and hence the attached climbing surface) to rise in order to create a lessened incline, depending on the direction in which the actuator is activated. As the actuator extends or retracts, and the climbing wall lowers or raises, the ends of the actuator will rotate about their hinged mounts.

In some embodiments, the first end of the actuator may be mounted to the base or an actuator support frame at a plurality of positions and/or the second end of the actuator may be mounted to the frame of the climbing wall at a plurality of positions in order to provide the climbing surface with a wider range of angles. For instance, in some embodiments, the connection between the actuator and the wall frame may be adjustable, such that the actuator may be moved between a first actuator attachment position and a second actuator attachment position. When the actuator is in the first actuator attachment position, the climbing surface may be moved within a first permitted range of incline angles. When the actuator is in the second actuator attachment position, the climbing surface may be moved within a second permitted range of incline angles. The second permitted range of incline angles differs from the first permitted range of incline angles. For instance, the first permitted range of incline angles may include a range including a substantially vertical orientation (about 0° with respect to a vertical axis) down to a first maximum incline angle. The second permitted range of incline angles may span to a second maximum incline angle, the second maximum incline angle being greater than the first maximum incline angle. In this way, a climbing wall have a larger range of incline angles may be provided.

In other embodiments, the system may also include an upper unit. The upper unit may contain at least a first (inner) structural element and a second (outer) structural element that are connected together by a hinge. The first structural element may be hingedly mounted to the support wall and the second structural element may be hingedly attached to the frame of the climbing wall. In this embodiment, the actuator may be configured to adjust the incline of the climbing surface by causing at least one of the first and second structural elements to rotate about the one or more hinges, such that an upper portion of the frame (and hence the attached climbing surface) is either lowered to create a greater incline or raised to lessen the incline, depending on the direction in which the actuator is activated.

Embodiments of the space-saving, adjustable-incline climbing wall are configured so that the climbing surface may be positioned at substantially any desired angle of incline within a permitted range. In other words, the climbing wall is not limited to a number of preset angles that can be obtained. Rather, by activating the actuator, one may gradually adjust the climbing surface to substantially any desired angle within the permitted range of movement. When the desired angle is reached, the actuator may simply be deactivated. Desirably, the permitted range of movement includes at least the range between substantially vertical (i.e. about 90°) and about 70° relative to the ground surface, more desirably the permitted range of movement includes at least the range between substantially vertical and about 60° relative to the ground surface, more desirably the permitted range of movement includes at least the range between substantially vertical and about 50° relative to the ground surface.

Embodiments of the adjustable-incline climbing wall may also comprise a wall extension panel, which extends the climbing experience when the climbing surface is brought to an inclined orientation. The wall extension panel is attached to the top of the frame and is configured to move between a first position and a second position. In its first position, the wall extension panel may be substantially parallel with the ground surface. The wall extension panel is in the first position, for instance, when then climbing surface is substantially vertically oriented. In its second position, the wall extension panel is aligned at substantially the same angle (relative to the ground surface) as the rest of the climbing surface. The wall extension panel may be brought into the second position by movement of the climbing surface from a substantially vertical orientation to an inclined orientation. Conversely, the wall extension panel may be brought from the second position to the first position by movement of the climbing surface from an inclined orientation back to a substantially vertical orientation.

Embodiments of the adjustable-incline climbing wall may also be configured to provide a user with a variety of exercise options. Some of the exercise options may be performed with the wall either in a vertical orientation or at an incline, while other exercise options are best performed with the wall in an inclined orientation. By providing a variety of angles of incline, embodiments of the climbing wall may provide improved resistance training opportunities, suspension training opportunities, weight training opportunities, etc., that can be tailored and optimized for a particular user.

For instance, embodiments of the climbing wall comprise a workout panel, which provides opportunities for a user to perform one or more exercises. For example, the workout panel may comprise a chin-up bar, a hang board, an element configured for mounting suspension training equipment, an element configured for mounting one or more resistance bands, or a combination thereof. The workout panel may be angled with respect to the climbing surface so that the workout panel extends substantially vertically when the climbing surface is inclined at a particular angle. By adjusting the incline of the climbing wall, one may adjust the height at which the one or more fitness elements on the workout panel is located, allowing for people of all heights to utilize the one or more elements on the workout panel at an optimum height.

Embodiments of the climbing wall may also comprise one or more fitness accessories mounted to the climbing surface. For example, the climbing wall may comprise one or more elements configured to receive a resistance band, a fitness rope, a suspension trainer, or a combination thereof. In some embodiments, for example, one may attach a resistance band to the climbing wall at one or more locations in order to perform a range of different exercises. Similarly, in some embodiments, one may attach a fitness rope to the climbing wall at one or more locations in order to perform a range of different exercises. In some embodiments, one may attach a suspension trainer to the climbing wall at one or more locations in order to perform a range of different exercises. As another example, embodiments of the climbing wall may comprise one or more ledges on which one can rest one's hands and support one's body weight during a variety of exercises and/or on which one can sit while performing a variety of exercises. In some embodiments, one or more of the fitness accessories mounted to the climbing surface may also be configured to serve as climbing grips.

Embodiments of the present disclosure are also directed to a climbing wall having a plurality of climbing grips, fitness accessories, or a combination thereof, that can be easily mounted to and removed from the climbing surface without the use of any tools. Accordingly, a user can remove and replace a variety of climbing grips and/or fitness accessories in order to customize the climbing wall for a particular use or uses.

For instance, in some embodiments, the climbing wall may comprise a plurality of mounting plates attached to the climbing surface. The mounting plates may each have an aperture that comprises a first portion configured to accept a tab element and a second portion configured to secure the tab element to the mounting plate. A plurality of climbing grips and/or fitness accessories may comprise a tab element that is configured to access the aperture at the first portion. After placing the mounting element into the first portion of the aperture, the tab element can then be slid in at least two different directions, e.g. horizontally and then vertically (downward), to bring the tab element into the second portion of the aperture, in which the climbing grip and/or fitness accessory is secured to the mounting plate on the climbing surface. Similarly, the climbing grip and/or fitness accessory may be removed from the climbing surface by sliding it (and its associated tab element) in at least two different directions, e.g. vertically (upward) and then horizontally, before pulling the climbing grip and/or fitness accessory away from the climbing surface, such that the tab element is removed from the first portion of the aperture. This configuration allows for easy mounting and removal of components without the use of any tools, but at the same time prevents the components from being accidentally dislodged from the climbing surface during use.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
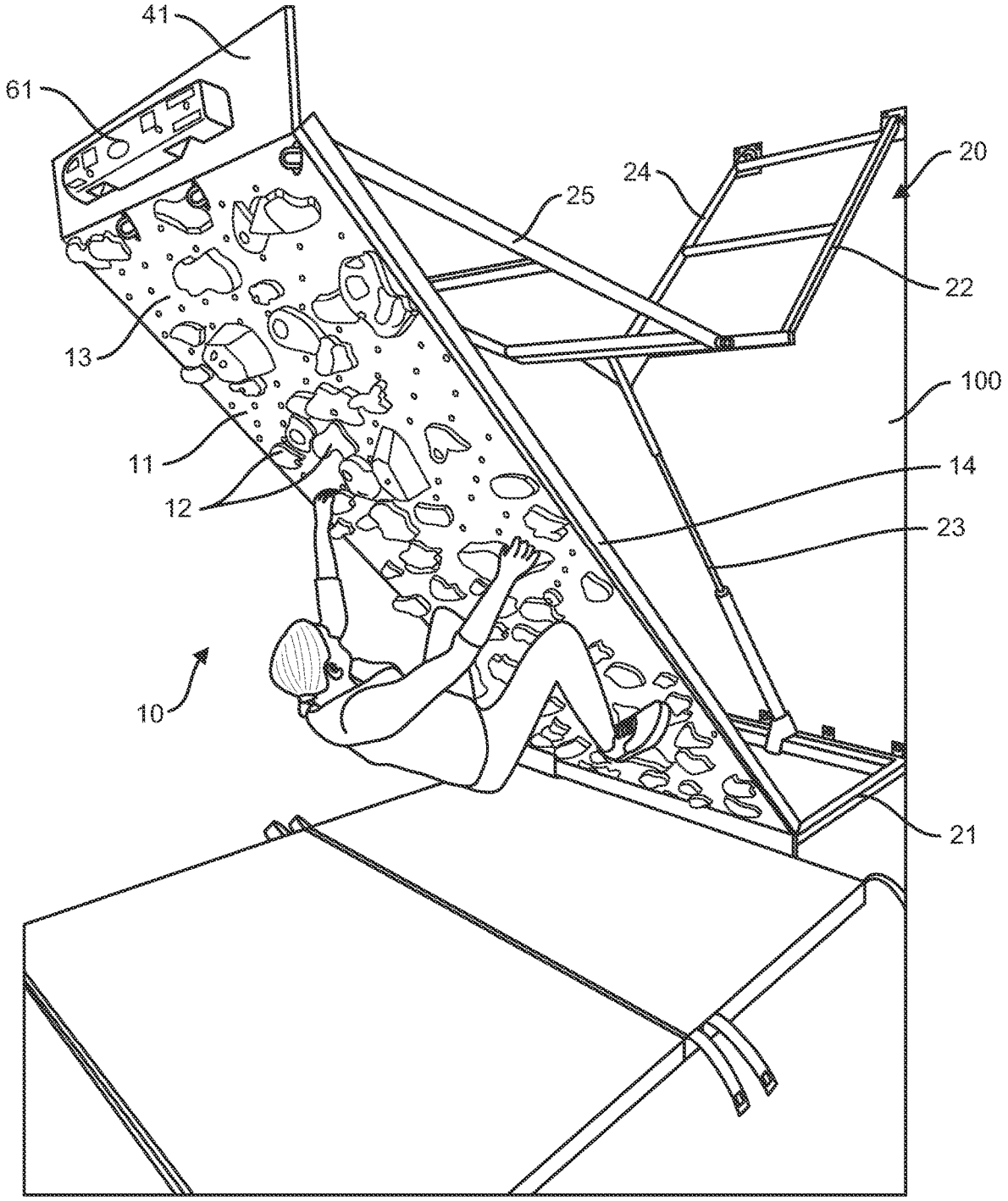
FIG. 1 is a front perspective view of an embodiment of a climbing wall of the present disclosure, showing use of the climbing wall at a desired angle of incline.
Figure 2:
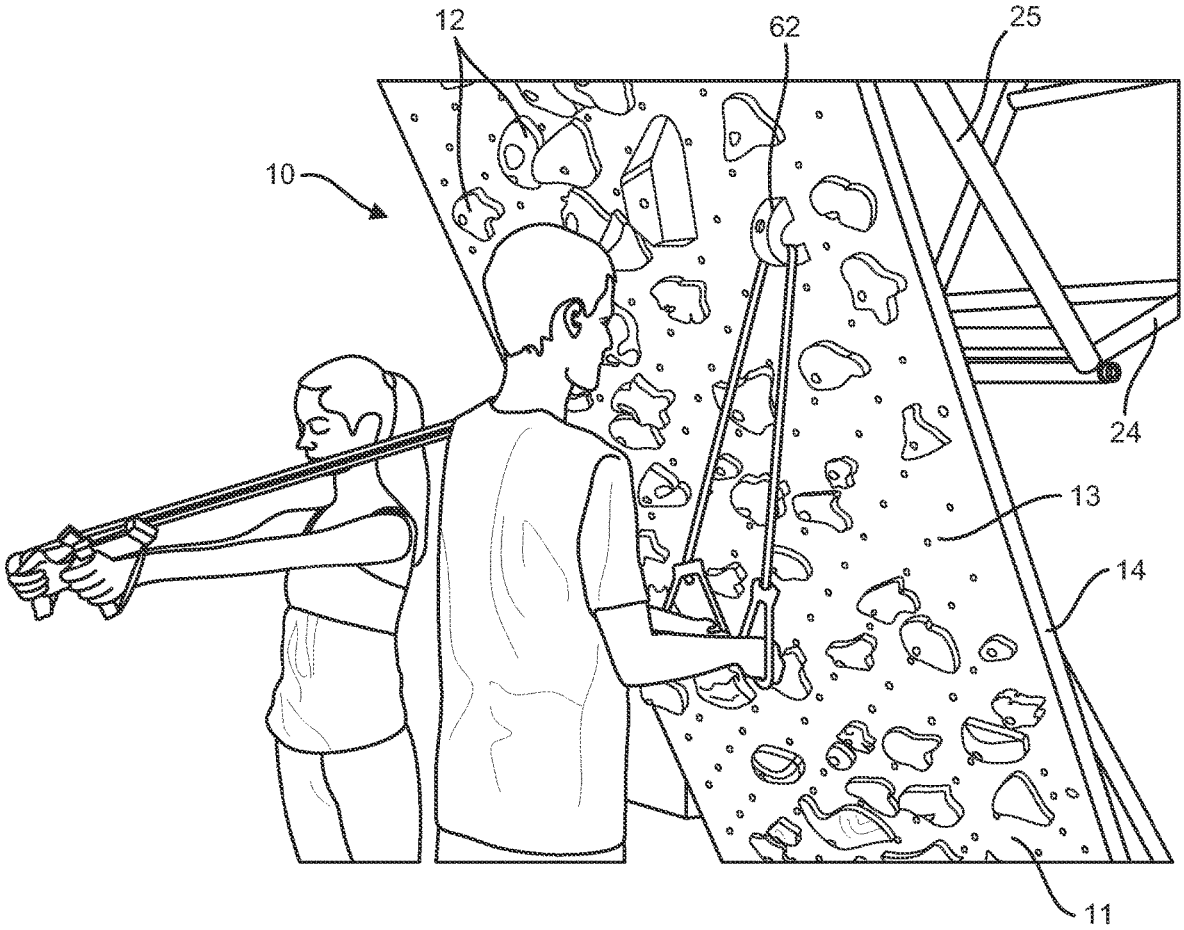
FIG. 2 is a front perspective view of an embodiment of a climbing wall of the present disclosure, showing use of the climbing wall for resistance exercises.

Embodiments of the present disclosure are directed to an adjustable-incline climbing wall. The adjustable-incline climbing wall of embodiments of the present disclosure is designed so that it may be moved between (a) a substantially vertical orientation, in which the climbing surface is substantially perpendicular, i.e. about 90° with the ground surface, and (b) an inclined orientation, in which the climbing surface may be positioned at substantially any desired angle of incline within a permitted range. In this way, the adjustable-incline climbing wall may be used and stored in a substantially vertical orientation, thus minimizing the amount of room space taken up by the climbing wall. If desired, however, the climbing wall may be lowered into an inclined orientation, rendering the climbing experience to have different degrees of difficulty or added challenges and/or presenting the opportunity for other exercise activities. Embodiments of the climbing wall are configured so that a user may easily bring the climbing surface to a desired angle of incline and may just as easily return the climbing wall to a substantially vertical orientation when finished with it.

Embodiments of the adjustable-incline climbing wall 10 disclosed herein comprise one or more climbing panels 11 containing a plurality of climbing grips 12. The front surface of the one or more climbing panels 11 that contains the plurality of climbing grips 12 is known as the climbing surface 13. In some embodiments, the climbing surface 13 may be formed by a single climbing panel 11. In other embodiments, multiple climbing panels 11 may be aligned with one another to form a substantially continuous climbing surface 13. The surface(s) of the one or more climbing panels 11 that make up the climbing surface 13 may be textured or may be smooth. A plurality of climbing grips 12 are affixed to the one or more climbing panels 11 and extend from the climbing surface 13. The plurality of climbing grips may have a variety of configurations, as is generally understood by those of skill in the art. The one or more climbing grips are not, for instance, limited to those shown in the illustrated embodiments.

The one or more climbing panels 11 are supported by a frame 14. For instance, the surface of the one or more climbing panels 11 opposite the climbing surface 13 may be attached to the frame 14, as shown in the illustrated embodiments.

As shown in the illustrated embodiments, the frame 14 may comprise a rectangular structure that is dimensioned to substantially correspond with the periphery of the climbing surface 13 and one or more strengthening crossbars that span between opposing sides of the structure. However, the frame 14 need not have the configuration shown in the illustrated embodiments so long as it adequately provides structural stability for the entirety of the climbing surface 13. In some embodiments, wall edge elements 15 may be attached to the side of the climbing wall 10, which is formed by the frame 14 and the one or more climbing panels 11. These wall edge elements 15 ensure that the sides, i.e. edges, of the climbing wall 10 are smooth and planar.

Moreover, although the edges of the climbing surface 13 in the illustrated embodiments are shown as substantially corresponding with elements of the frame 14, the one or more climbing panels 11 may also be configured so that the climbing surface 13 extends horizontally beyond than the frame 14. Extension of the climbing surface 13 beyond the frame 14, however, is limited by the need for maintaining structural stability during use. Accordingly, if the climbing surface 13 extends a relatively large distance beyond the frame 14, additional frame elements may be used to increase the structural stability of the extended climbing surface.

Figure 9:
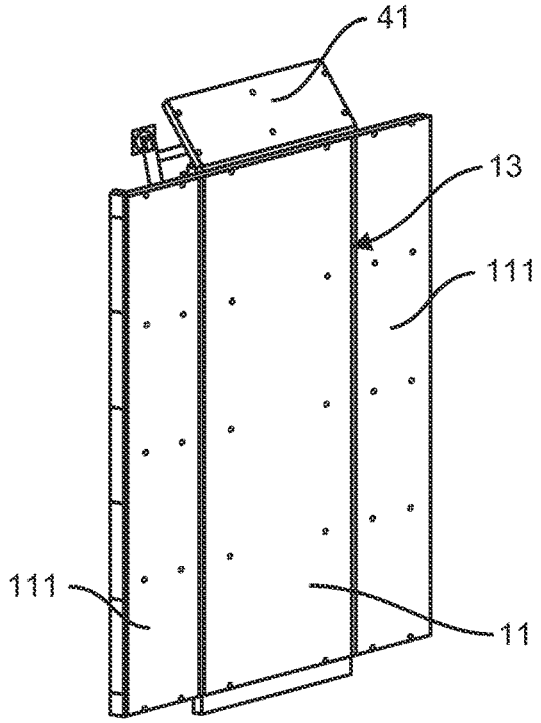
FIG. 9 is a front perspective view of an embodiment of a climbing wall of the present disclosure, including climbing surface width extension panels.
Figure 10:
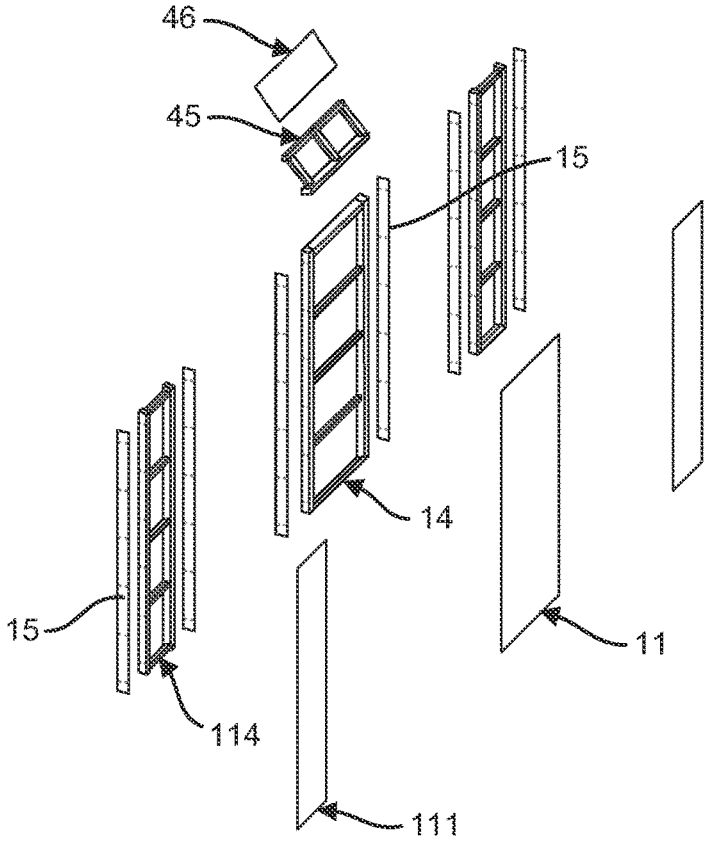
FIG. 10 is an exploded perspective view of an embodiment of a climbing wall of the present disclosure, including climbing surface width extension panels.

In some embodiments, for instance, additional frame structures 114 may be used to support an extended-width climbing surface 13. One embodiment of such an extended-width climbing wall 10 is shown in FIGS. 9 and 10. In the illustrated embodiment, the central portion of the climbing surface 13 is provided by a central climbing panel 11. Additional climbing panels 111 are mounted next to the central climbing panel 11 on each of a first side and a second side. This may be achieved using frame extension elements 114, which provide structural support for the additional climbing panels 111. As shown in FIG. 10, for instance, frame extension elements 114 are affixed to the first and second sides of the central frame 14.

In the illustrated embodiment, the frame extension elements 114 are configured in the same manner as the primary frame element 14, i.e. a rectangular structure and a plurality of strengthening crossbars, although other configurations are also contemplated. As shown in the illustrated embodiment, wall edges 15 may be provided in between the central frame element 14 and the frame extension elements 114, although it is also contemplated that a single component could be used or that the frame elements 14, 114 and/or climbing panels 11, 111 could themselves be affixed together and the wall edge components 15 eliminated. Any of these configurations may be suitable to prevent a gap between the central climbing panel 11 and the additional climbing panel 111 and thereby provide a substantially continuous climbing surface 13. Moreover, although the illustrated embodiment shows a substantially planar climbing surface 13, it is also contemplated that the additional climbing panels 111 could be mounted at an angle with the central climbing panel 11 without departing from the scope of the present description.

Using embodiments such as that shown in FIGS. 9-10, the width of a climbing surface 13 may be increased without requiring any changes to the dimensions of the components that make up the incline adjustment system 20. For example, the same incline adjustment systems 20 shown in FIGS. 3-8 may be used in combination with a climbing wall 10 having an extended climbing surface 13, such as that shown in FIGS. 9-10. This allows for the relatively low-cost design of adjustable-incline climbing walls 10 having a range of desirable widths using the same basic set of components, meaning that the climbing walls can be custom designed to fit a variety of needs or spatial requirements. The connection between the central frame element 14 and the frame extension elements 114 may also be used to attach a protective cover 50, such as is described herein.

Embodiments of the adjustable-incline climbing wall 10 disclosed herein also comprise a system 20 for adjusting the incline of the climbing surface 13. The system 20 may include a base unit 21, an optional upper unit 22, and an actuator 23.

The base unit 21 provides a stable surface which supports the lower end of the climbing wall 10, and more particularly the lower end of the frame 14, throughout the permitted range of incline angles. The base unit 21 comprises a first end 21*a* and a second end 21*b*. The climbing wall 10, and more particularly the lower end of the frame 14, may be hingedly attached to the first end 21*a* of the base unit 21. The first end 21*a* rests on the ground surface. For example, in some embodiments the first end 21*a* may comprise one or more feet configured to rest on the ground surface. The one or more feet may be adjustable so that the height of the first end 21*a* may be fine-tuned. In other embodiments, the first end 21*a* of the base unit may rest directly on the ground surface. The first end 21*a* comprises an upper surface, on which the bottom edge of the climbing wall 10, including at least the bottom edge of the frame 14, may rest. The first end 21*a* may also comprise a front surface. In some embodiments, such as is illustrated in FIG. 1, the front surface of the base unit 21 may have the same or a similar appearance to the climbing surface 13.

Figure 19:
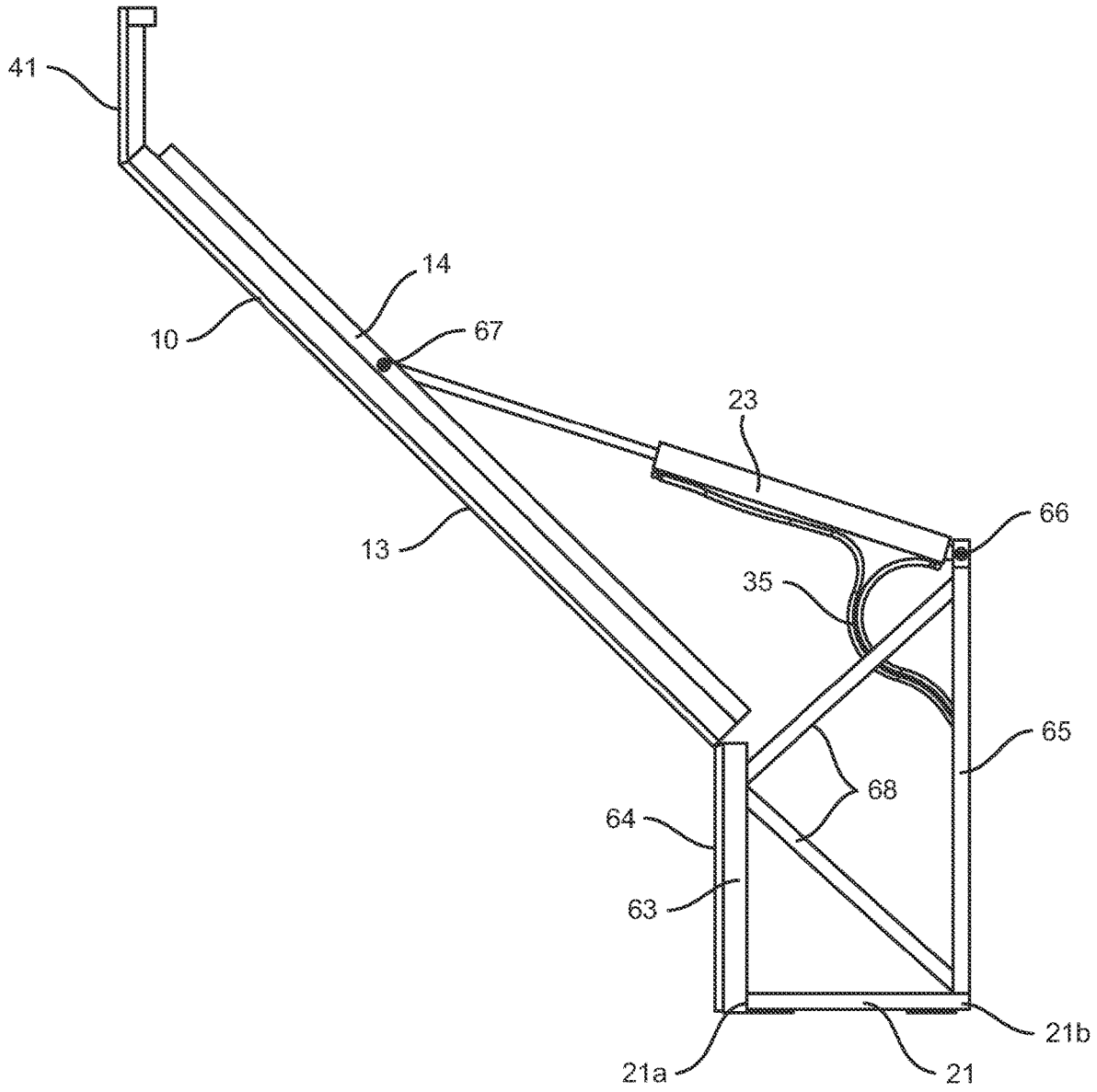
FIG. 19 is a side elevation view of the embodiment of FIG. 18, showing the climbing wall in an inclined orientation.
Figure 20:
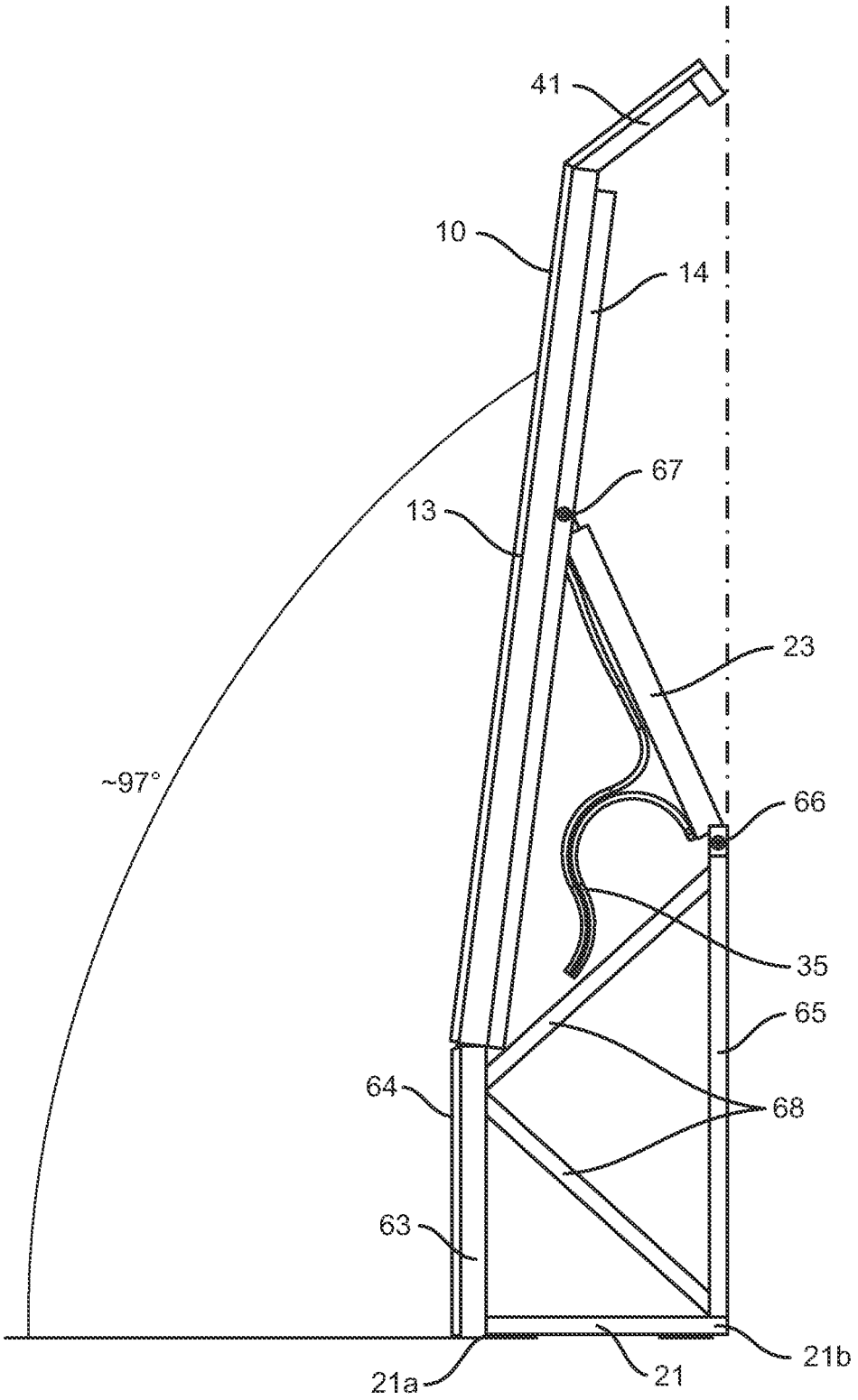
FIG. 20 is a side elevation view of the embodiment of FIG. 18, showing the climbing wall in a retracted orientation.
Figure 21:
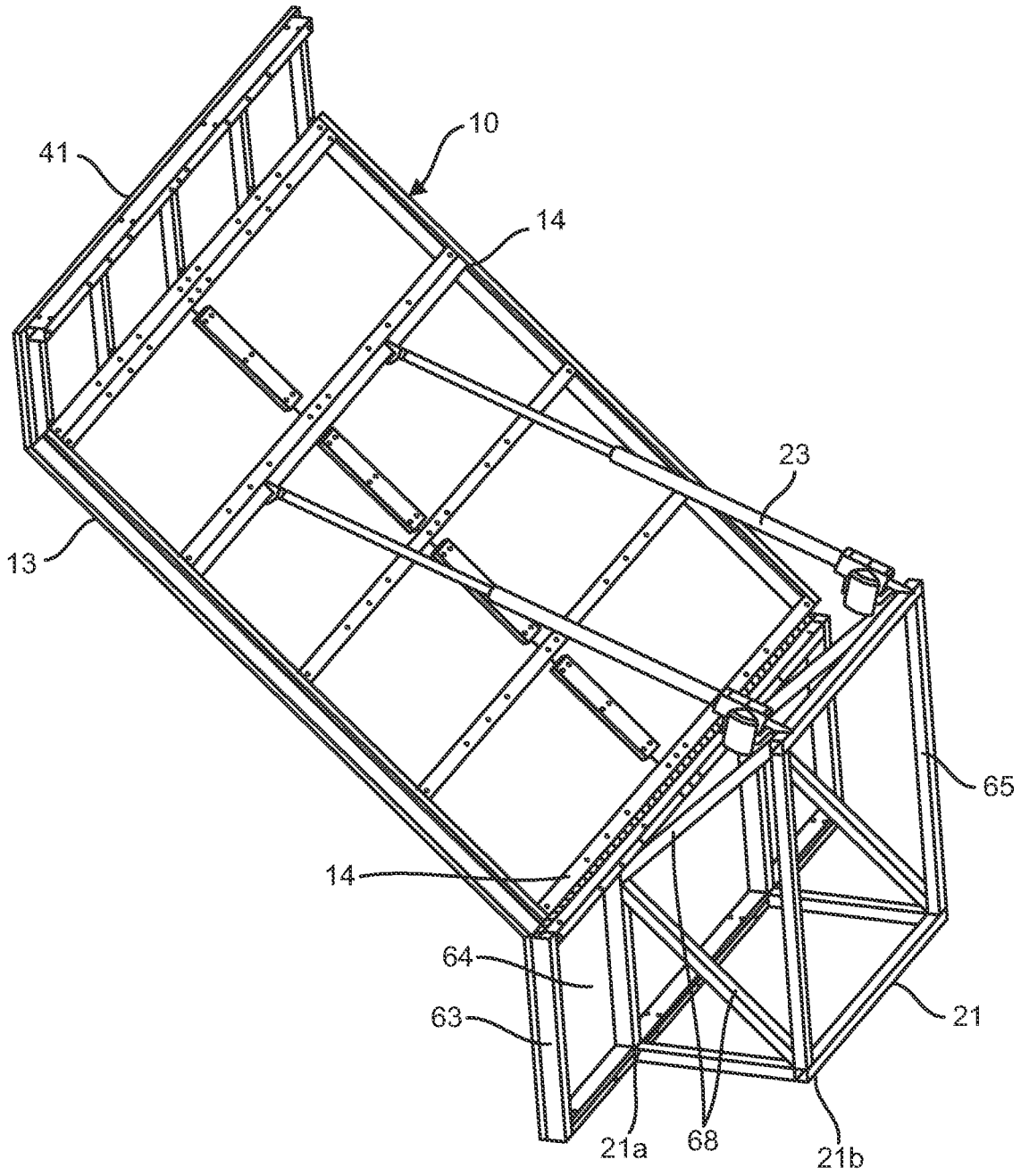
FIG. 21 is a rear perspective view of an embodiment of a climbing wall of the present disclosure, showing the climbing wall in an inclined orientation.

In some embodiments, such as those shown in FIGS. 18-22, the first end of the base unit 21 may comprise a fixed frame element 63 that supports the climbing wall frame 14 in a raised position. The climbing wall 10, and more particularly the lower end of the frame 14, thus may be hingedly attached to the top of the fixed frame element 63, as is best shown in FIG. 21.

Figure 18:
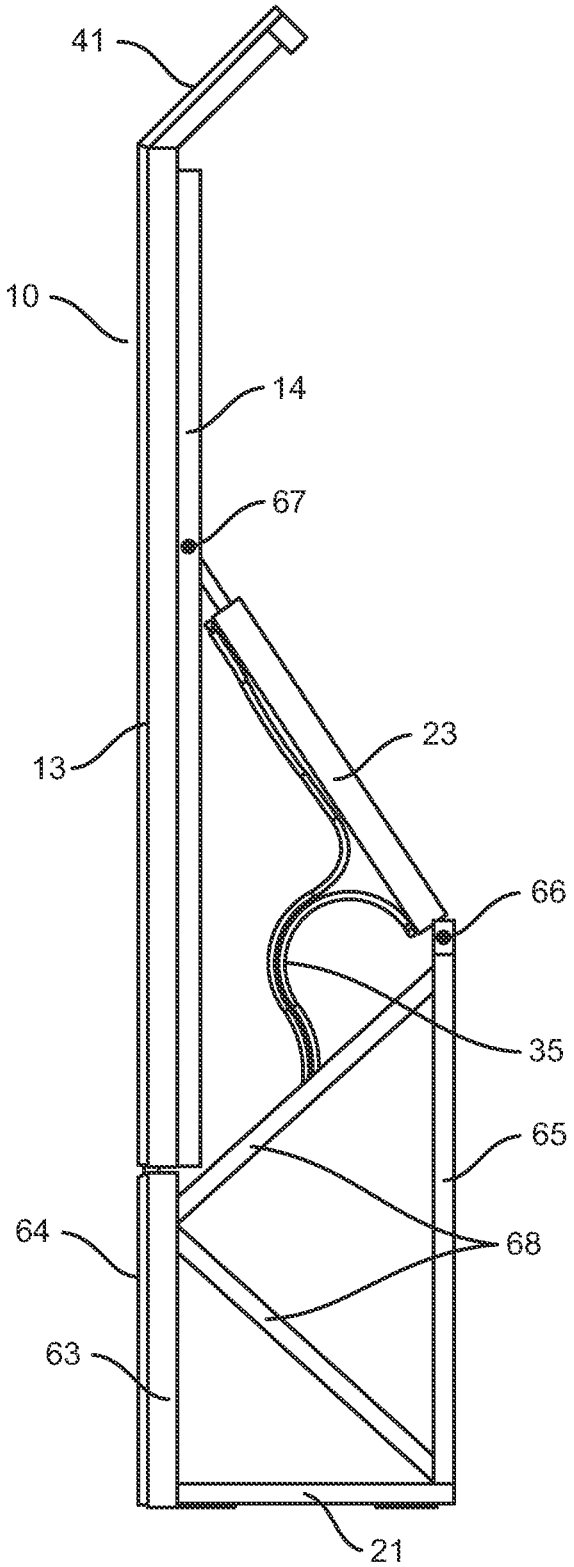
FIG. 18 is a side elevation view of an embodiment of a climbing wall of the present disclosure, showing the climbing wall in a substantially vertical orientation.
Figure 22:
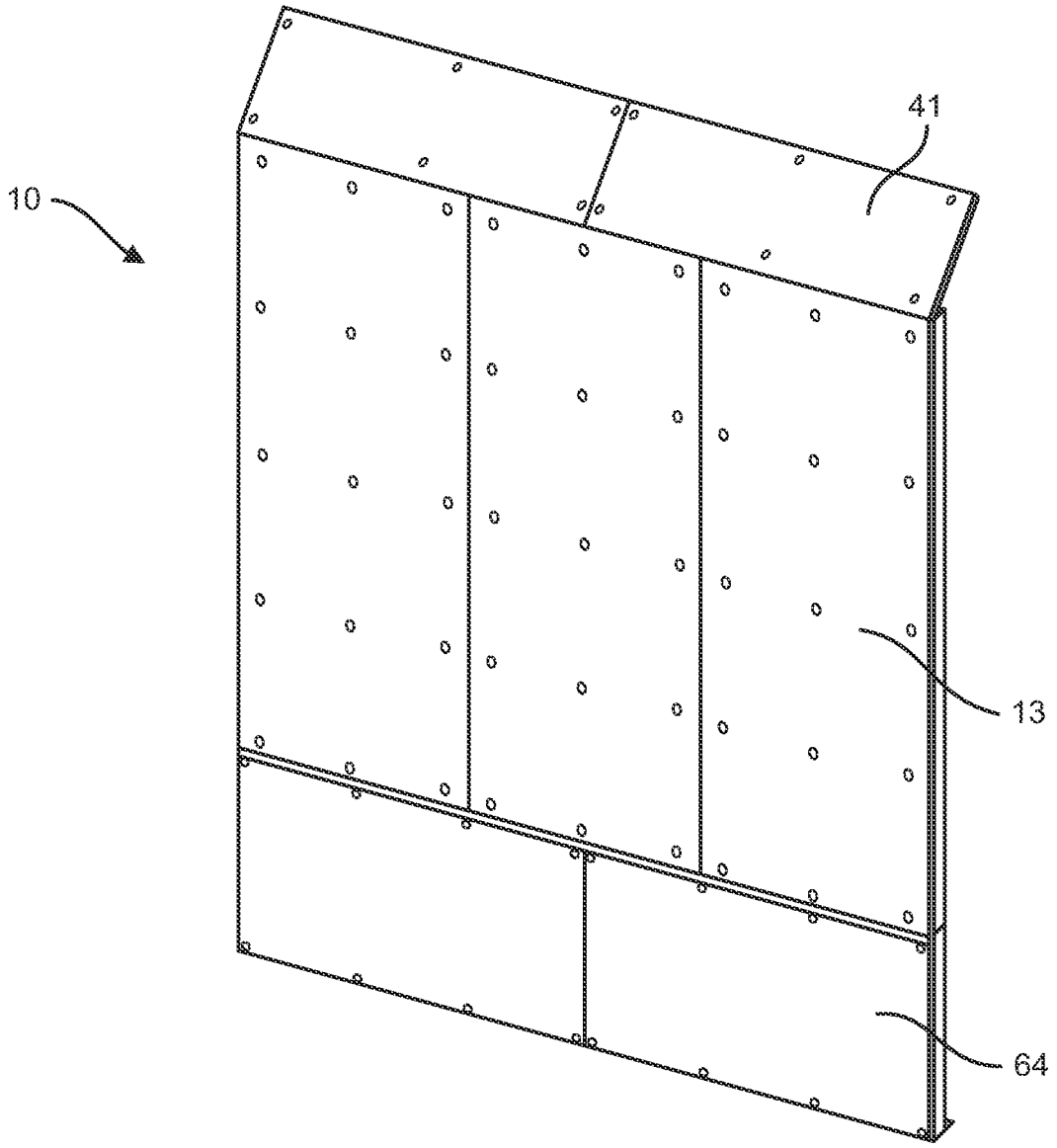
FIG. 22 is a front perspective view of an embodiment of a climbing wall of the present disclosure, having a climbing surface defined by a first fixed portion and a second, inclinable portion; and further including a workout panel.

The fixed frame element 63 may comprise a front surface 64 that serves as a lower, fixed portion of the climbing surface 13. An example is shown in FIG. 22. In some embodiments, one or more climbing grips 12 may be attached to the lower, fixed portion of the climbing surface 13 whereas in other embodiments the lower, fixed portion of the climbing surface may not comprise any climbing grips. In some embodiments, the lower, fixed portion of the climbing surface 13 may comprise one or more exercise accessories, such as one or more step-up elements, one or more seating elements, one or more ledge elements for use in elevated push-ups, or the like. As shown in FIG. 18, the front surface 64 may be beveled at the top edge in order to allow space to accommodate the downward movement of the climbing surface 13 when the wall 10 is brought into an inclined orientation.

The height of the fixed frame element 63 may vary. In some embodiments, for example, the top of the fixed frame element 63 may be between about 20 inches and about 40 inches above the ground, alternatively between about 24 inches and about 36 inches above the ground. The height of the fixed frame element 63 may be selected to provide a desired starting height for the inclined climbing surface 13, taking into account the thickness of the safety mat that will be used. For instance, the top of the fixed frame element 63 may be about 30 inches above the ground, which, after taking into account a six-inch thick safety mat, will provide a two-foot substantially vertical climbing surface prior to the inclined climbing surface. If, on the other hand, a twelve-inch thick safety mat was to be used, the top of the fixed frame element 63 would have to be about 36 inches above the ground in order to provide the same two-foot substantially flat climbing surface prior to the start of the inclined climbing surface. The top of the fixed frame element 63 may be at least six inches above the ground in order to accommodate a six-inch safety mat, alternatively at least twelve inches above the ground in order to accommodate a twelve-inch safety mat.

The second end 21*b* of the base unit 21 may be mounted to a support wall 100. In the illustrated embodiments, at least two stability-providing beams, one on either end of the support surface, span between the first end 21*a* and the second end 21*b* of the base unit 21. Depending on the width of the base unit, however, additional stability-providing beams may also be spaced, desirably equidistantly, between the two ends of the support surface. In some embodiments, the second end 21*b* may be configured to be mounted to the support wall 100 only where the stability-providing beams intersect with the support wall. Such an embodiment is shown, for example, in FIG. 7. In other embodiments, the second end 21*b* may also comprise a crossbar that provides additional positions for mounting to the support wall 100. Such an embodiment is shown, for example, in FIG. 11. The base unit 21 is desirably positioned close to the ground surface, such as within about 12 inches above the ground surface, more desirably within about 6 inches above the ground surface.

Figure 3:
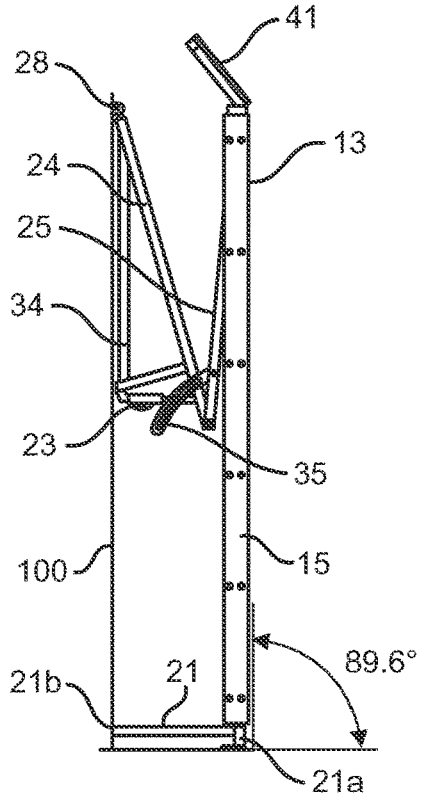
FIG. 3 is a side elevation view of an embodiment of a climbing wall of the present disclosure that includes a workout panel, showing the climbing wall in a substantially vertical orientation.
Figure 4:
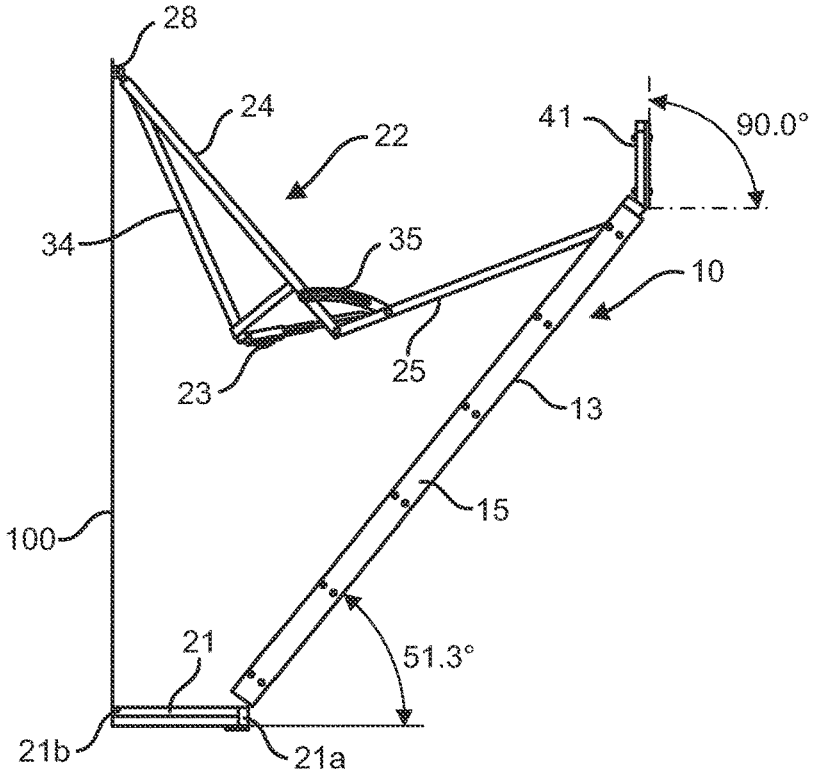
FIG. 4 is a side elevation view of an embodiment of a climbing wall of the present disclosure that includes a workout panel, showing the climbing wall in an inclined orientation.

During movement of the climbing wall 10 from a substantially vertical orientation to an inclined orientation, and vice versa, the lower end of the climbing wall (and more particularly the lower end of the frame 14) rotates about its hinged connection with the first end 21*a*, as illustrated for example in FIGS. 3 and 4. When in an inclined orientation, the forces placed on the climbing wall 10 during use are transferred through the base unit 21 into a combination of the ground surface and the support wall 100.

The upper unit 22 comprises an inner unit 24 and an outer unit 25 that are hingedly connected together. The inner unit 24 and the outer unit 25 span between the climbing wall 10, more particularly the frame 14, and the support wall 100. Activation of the actuator 23 causes the inner unit 24 and the outer unit 25 to travel with respect to one another, which can either (a) cause the upper portion of the climbing wall 10 to tilt downward, placing the climbing surface 13 at an angle less than about 90° relative to the ground surface or (b) cause the upper portion of the climbing wall 10 to tilt upward, bringing the climbing surface 13 back to a substantially vertical orientation.

The inner unit 24 comprises a first end 24*a* and a second end 24*b*. The first end 24*a* is mounted to the support wall 100. The first end 24*a* may be hingedly mounted to the support wall 100. For instance, system 20 may comprise one or more wall mounts 28. The wall mounts may be affixed to the wall using conventional methods. The first end 24*a* may then be attached to the one or more wall mounts 28 in such a way that the inner unit 24 is able to rotate on the one or more wall mounts 28, so that the inner unit may move toward and away from the support wall 100. In the illustrated embodiments, the wall mounts 28 are positioned at about the same height as the top of the frame 14 of the climbing wall 10 (when the climbing wall is in a substantially vertical orientation), or slightly above the top of the frame. However, other embodiments are contemplated in which the wall mounts 28 may be positioned lower along the support wall 100, such as where the orientation of the inner unit 24 and outer unit 25 may be reversed from that shown in the illustrated embodiments.

The second end 24*b* is coupled to the outer unit 25. The second end 24*b* may comprise a hinge component 26. For example, the second end 24*b* may comprise one or more hollow tubes that surround a portion of a pivot shaft 29. Accordingly, when the actuator is activated, the hinge component 26, and thus the second end 24*b*, may rotate about the pivot shaft 29. Alternatively, the second end 24*b* may serve as, or be fixed to, a pivot shaft 29, such that the second end 24*b* does not itself rotate during activation of the actuator but rather merely provides a hinge pin for the rotation of the outer unit 25.

The outer unit 25 comprises a first end 25*a* and a second end 25*b*. The first end 25*a* is attached to the climbing wall 10, and more particularly to the frame 14 of the climbing wall. The first end 25*a* may be hingedly mounted to the climbing wall 10, and more particularly to the frame 14 of the climbing wall. In the illustrated embodiments, the first end 25*a* is attached to the upper beam of the frame 14. However, other embodiments are contemplated in which the first end 25*a* may be attached to the frame 14 at a lower position, such as where the orientation of the inner unit 24 and outer unit 25 may be reversed from that shown in the illustrated embodiments.

The second end 25*b* is coupled to the inner unit 24. The second end 25*b* may comprise a hinge component 27. For example, the second end 25*b* may comprise one or more hollow elements that surround a portion of a pivot shaft 29. Accordingly, when the actuator is activated, the hinge component 27, and thus the second end 25*b*, may rotate about the pivot shaft 29. Alternatively, the second end 25*b* may serve as, or be fixed to, a pivot shaft 29, such that the second end 25*b* does not itself rotate during activation of the actuator but rather merely provides a hinge pin for the rotation of the inner unit 24.

Figure 7:
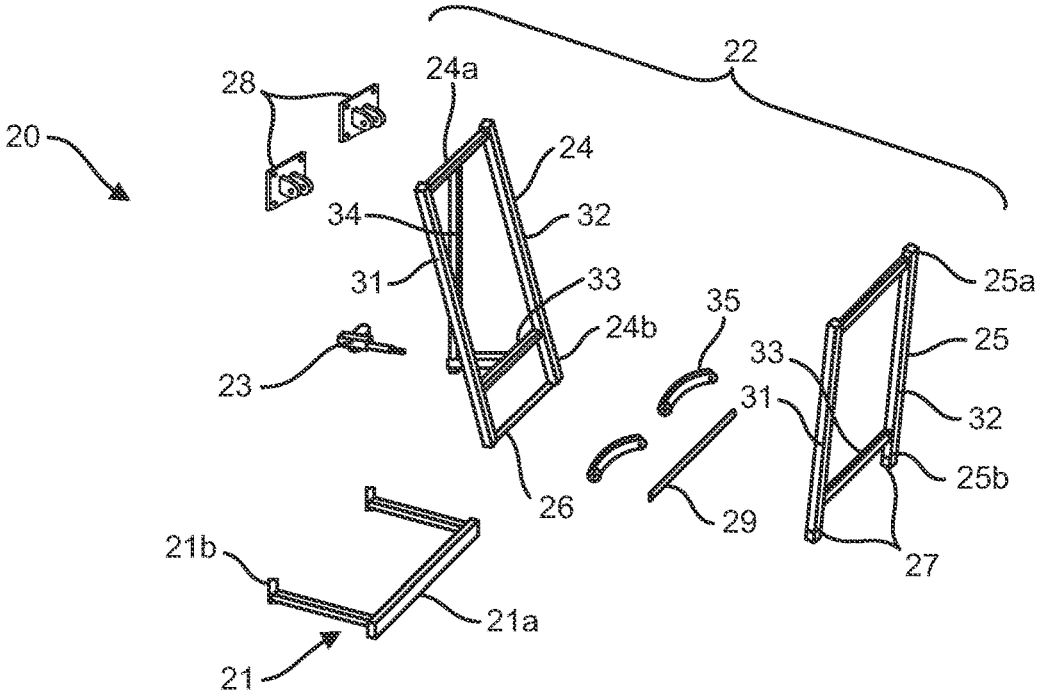
FIG. 7 is an exploded perspective view showing the components that make up an embodiment of a system for adjusting the incline of a climbing wall.

In the illustrated embodiments, for instance, the second end 25*b* comprises a hollow portion 27 at each side that is configured to receive the pivot shaft 29. As can be seen in FIG. 7, the hollow tube 26 located at the second end of the inner unit 24*b* surrounds a first portion of the pivot shaft 29 and the hollow portions 27 located at the second end of the outer unit 25*b* surrounds a second portion of the pivot shaft. Many other configurations for the hinge are also contemplated, including the reverse of the illustrated embodiment (in which the outer unit 25 comprises the single hollow tube and the inner unit 24 links to the ends of the hinge pin 29), as well as embodiments that utilize one of the various hinge arrangements that would be understood by one of skill in the art. In fact, any hinge design may be employed, so long as the inner unit 24 and/or the outer unit 25 rotate about the hinge so as to move from a closed position, such as that shown in FIG. 3, to an open position, such as that shown in FIG. 4.

Structurally, each of the inner unit 24 and the outer unit 25 may comprise a first side post 31, a second side post 32, and one or more crossbars 33 spanning between the first and second side posts. The ends of the first and second side posts 31, 32 define the first end 24*a*, 25*a* and the second end 24*b*, 25*b* of the inner and outer units 24, 25. The one or more crossbars 33 provide additional structural stability to the inner and outer units 24, 25. The one or more crossbars 33 may also be used to mount the actuator 23 to the inner unit 24, the outer unit 25, or both.

In some embodiments, including for example those illustrated in FIGS. 3-8, the actuator 23 may be mounted to each of the inner unit 24 and the outer unit 25. By doing so, the overall footprint of the climbing wall 10 assembly can be minimized. In other embodiments, including for example those illustrated in FIGS. 1 and 11, the actuator 23 may be mounted to each of the base unit 21 and the outer unit 25. As can be seen in the drawings, the embodiment shown in FIGS. 1 and 11 makes use of a longer actuator 23 and thus requires a larger footprint. By using a shorter actuator 23 that is mounted to each of the inner unit 24 and the outer unit 25, the climbing wall 10 (when in a substantially vertical orientation) may be located less than 3 feet from the support wall 100, more desirably less than 2.5 feet, more desirably about 2 feet or less. In some embodiments, the base unit 21 may extend less than 3 feet from the support wall 100, more desirably less than 2.5 feet, more desirably about 2 feet or less.

In the embodiment shown in FIGS. 3-8, the inner unit 24 comprises an actuator support structure 34. The actuator support structure 34 extends from the rear of the inner unit 24 and is configured to both support the actuator 23 and provide stability to the system 20 during operation of the actuator. In the illustrated embodiment, the actuator support structure 34 supports a first end of the actuator 23 from above, although a variety of alternative designs may be used. The second end of the actuator 23 is attached to the outer unit 25. In the illustrated examples, the second end of the actuator 23 is attached to a crossbar 33 of the outer unit 25. However, the outer unit 25 may also comprise an actuator support structure if desired.

Figure 11:
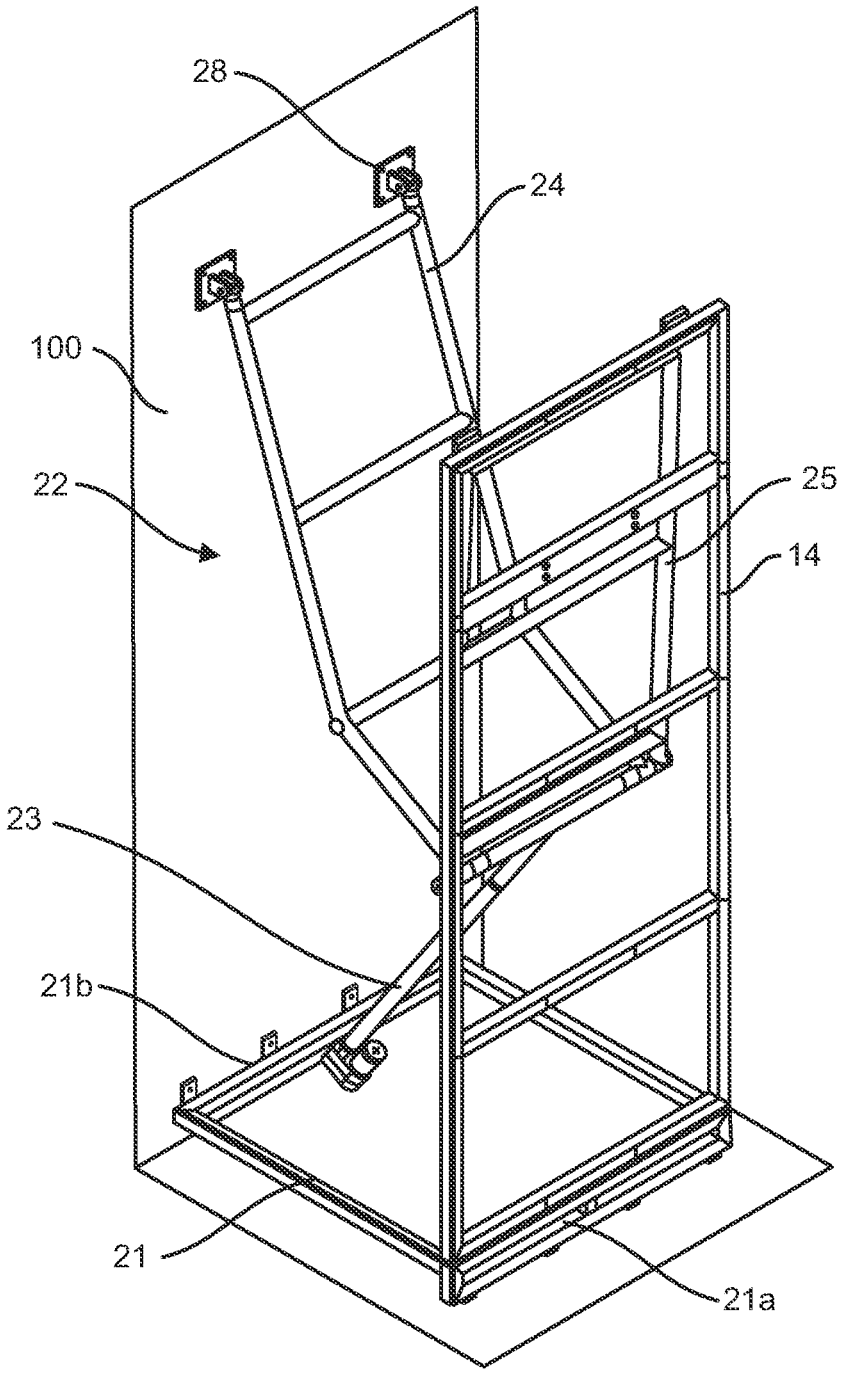
FIG. 11 is a front perspective view of an embodiment of a portion of a climbing wall of the present disclosure, showing the climbing wall in a substantially vertical orientation.

In the embodiment shown in FIGS. 1 and 11, a first end of the actuator 23 is mounted to the base unit 21, more particularly to the second end 21*b* of the base unit, and the second end of the actuator 23 is attached to the outer unit 25. In further non-illustrated embodiments, the first end of the actuator 23 may be mounted to the support wall 100.

Figure 16:
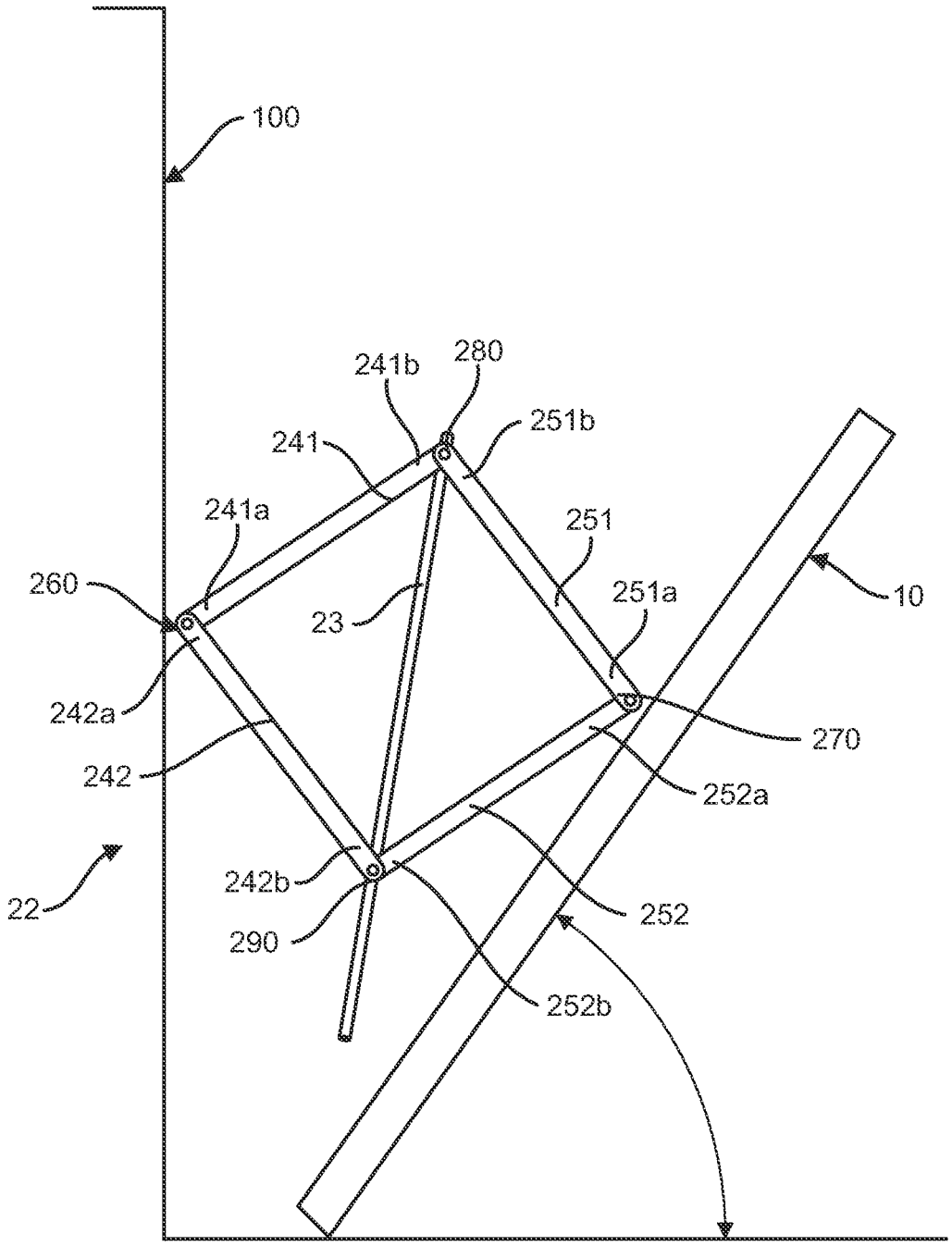
FIG. 16 is a side elevation view of an embodiment of a climbing wall of the present disclosure, wherein the upper unit of the system for adjusting the incline of the climbing surface comprises a scissor mechanism.
Figure 17:
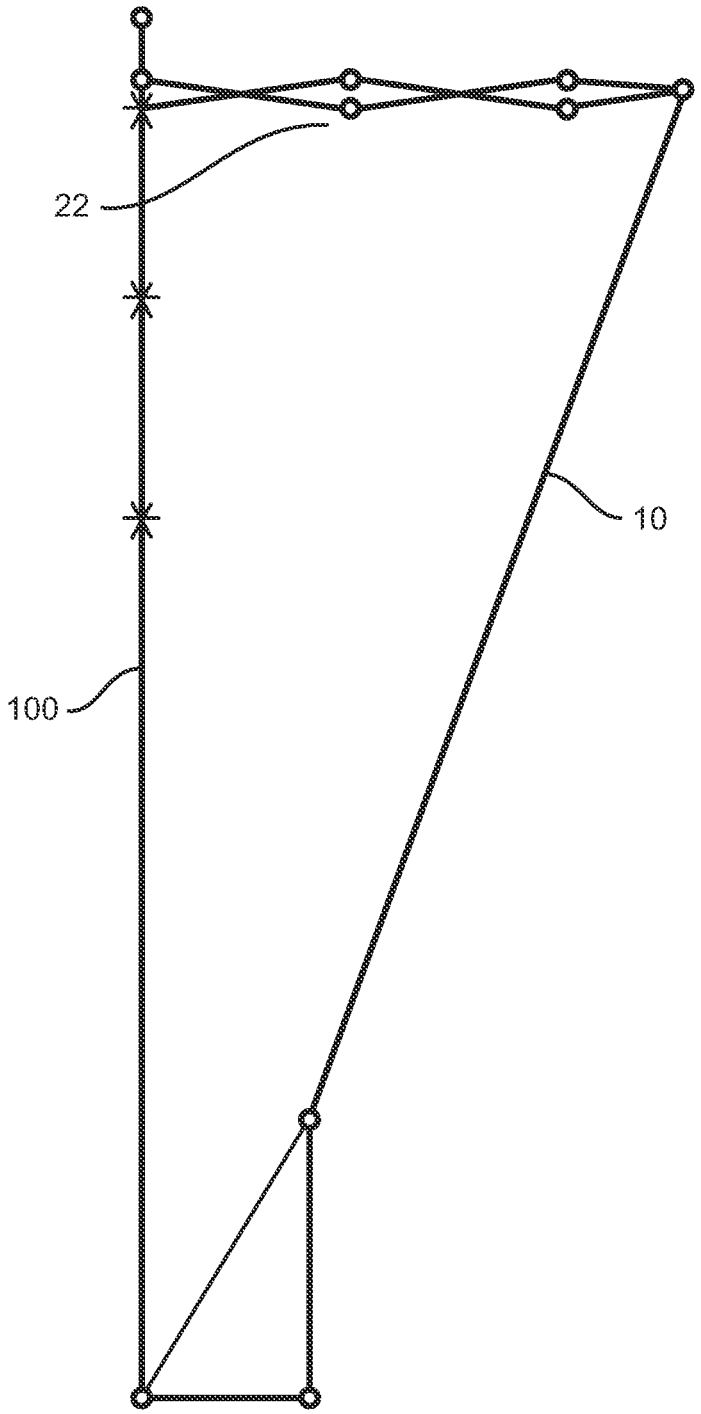
FIG. 17 is a side elevation view of an embodiment of a climbing wall of the present disclosure, wherein the upper unit of the system for adjusting the incline of the climbing surface comprises a scissor mechanism having multiple scissor elements.

In some embodiments, the upper unit 22 may utilize a scissor mechanism such as that shown in FIGS. 16 and 17. For instance, in some embodiments, the upper unit 22 may comprise at least a pair of inner units and a pair of outer units. The pair of inner units comprises a first, upper unit 241 and a second, lower unit 242. Similarly, the pair of outer units comprises a first, upper unit 251 and a second, lower unit 252. The first inner unit 241 comprises a first end 241*a* and a second end 241*b*. The second inner unit 242 comprises a first end 242*a* and a second end 242*b*. Similarly, the first outer unit 251 comprises a first end 251*a* and a second end 251*b* and the second outer unit 252 comprises a first end 252*a* and a second end 252*b*.

As with the embodiments described above, the first ends 241*a*, 242*a* of the pair of inner units are mounted to the support wall 100 and the first ends 251*a*, 252*a* of the pair of outer units are mounted to the climbing wall 10, and more particularly to the frame 14 of the climbing wall. Specifically, the first ends 241*a*, 242*a* of the pair of inner units are connected by a fixed pivot 260, which is mounted to the support wall 100. The first ends 251*a*, 252*a* of the pair of outer units are connected by a fixed pivot 270, which is mounted to the climbing wall 10, and more particularly to the frame 14 of the climbing wall.

The second ends 241*b*, 242*b* of the pair of inner units and the second ends 251*b*, 252*b* of the pair of outer units and hingedly connected. Specifically, the second end 241*b* of the first inner unit is hingedly attached to the second end 251*b* of the first outer unit by a free pivot 280. The second end 242*b* of the second inner unit is hingedly attached to the second end 252*b* of the second outer unit by a free pivot 290. As illustrated in FIG. 16, the actuator 23 may span between free pivot 280 and free pivot 290. Accordingly, when the actuator 23 is activated, free pivots 280, free pivot 290, or both may travel a selected distance along the actuator. As the distance between the free pivots 280, 290 is decreased, the pair of inner units 241, 242 and the pair of outer units 251, 252 will spread apart (more particularly, the first inner unit 241 and the first outer unit 251 will spread apart from one another; and the second inner unit 242 and the second outer unit 252 will spread apart from one another), causing the climbing wall 10 to tilt downward. As the distance between the free pivots 280, 290 is increased, the pair of inner units 241, 242 and the pair of outer units 251, 252 will come together (more particularly, the first inner unit 241 and the first outer unit 251 will come together with one another; and the second inner unit 242 and the second outer unit 252 will come together with one another), causing the climbing wall 10 to tilt upward toward a vertical orientation.

The embodiment illustrated in FIG. 17 comprises a scissor mechanism such as that illustrated in FIG. 16, but containing multiple scissoring elements.

In some embodiments, the actuator 23 may be connected directly to the climbing wall 10. For instance, a first end of the actuator 23 may be mounted to the base unit 21, more particularly to the second end 21*b* of the base unit, and the second end of the actuator 23 may be attached to the climbing wall 10, such as to the frame 14 of the climbing wall. In further non-illustrated embodiments, the first end of the actuator 23 may be mounted to the support wall 100 and the second end of the actuator 23 may be attached to the climbing wall 10, such as to the frame 14 of the climbing wall. In these embodiments, an upper support unit 22 may be excluded.

In some embodiments, such as that illustrated in FIGS. 18-21, the base unit 21, and in particular the second end 21*b* of the base unit, may also comprise an actuator support frame 65. The actuator support frame 65 may support the first end of the actuator 23 in a raised position. For instance, the actuator support frame 65 may support the first end of the actuator 23 at a height above the top of the fixed frame element 63. As with the height of the fixed frame element 63, the height of the actuator support frame 65 may vary. In some embodiments, for example, the top of the actuator support frame 65 may be between about 40 and about 60 inches above the ground, alternatively between about 45 inches and 55 inches above the ground. By raising the first end of the actuator 23 above the hinge point of the climbing wall 10, interference between the actuator and the hinging of the climbing wall 10 may be avoided and the rigidity of the adjustable-incline climbing wall system may be improved. Moreover, by raising the first end of the actuator 23 a desired distance vertically, the adjustable-incline climbing wall system may utilize a shorter actuator 23 to obtain a maximum degree of incline than where an actuator is connected between the second end of the base 21*b*, itself, and the frame 14 of the climbing wall 10.

The actuator support frame 65 may also take on a number of configurations. In FIG. 21, for example, the actuator support frame 65 comprises first and second vertical members and a crossbar member. However, in other embodiments, the actuator support frame 65 may comprise one or more additional vertical members, one or more additional crossbar members, or the like.

In some embodiments, the actuator support frame 65 may also include one or more additional actuator stabilization members 68. The actuator stabilization members 68 may be configured to stabilize the actuator support frame 65. For instance, the actuator support members 68 may connect the actuator support frame to the base (e.g. to the first end of the base 21*a*), to the fixed frame element 63, or both. The embodiments shown in FIGS. 18-21, for example, include a first set of actuator stabilization members 68 on a first side of the actuator support frame 65, i.e. corresponding to the first vertical member of the actuator support frame, and a second set of actuator stabilization members on a second side of the actuator support frame, i.e. corresponding to the second vertical member of the actuator support frame. Each set of actuator stabilization members 68 comprises a first stabilization member connecting the corner of the crossbar to a point on the fixed frame element 63 and a second stabilization member connecting the point on the fixed frame element to the second end of the base 21*b*.

The actuator stabilization members 68 may take any number of other, non-illustrated configurations as well. For example, the actuator stabilization members 68 may connect the crossbar to the first end of the base 21*a*. Or, for example, the actuator stabilization members 68 may connect the crossbar and the second end of the base 21*b*, such as in an "X"-shape from a first side of the base to a second side of the crossbar and from a second side of the base to a first side of the crossbar.

The first end of the actuator 23 may be hingedly (e.g. rotatably) connected to the actuator support frame 65, the second end of the actuator may be hingedly (e.g. rotatably) connected to the wall frame 14 of the climbing wall 10, or both. Accordingly, as the climbing wall 10 is brought from a substantially vertical position, such as is shown in FIG. 18, to an inclined position, such as is shown in FIG. 19, the actuator 23 may rotate downward about the hinged connection 66 between the first end of the actuator and the actuator support frame 65. Similarly, as the climbing wall 10 is brought from a substantially vertical position, such as is shown in FIG. 18, to an inclined position, such as is shown in FIG. 19, the actuator 23 may rotate about the hinged connection 67 between the second end of the actuator and the frame of the climbing wall 14.

The actuator 23 may be any linear actuator that is capable of withstanding at least 200 in-lbs. of force, such as may be placed on it during use of the climbing wall in an inclined position. The actuator 23 may be a pneumatic linear actuator, a hydraulic liner actuator, an electric linear actuator, or a ball screw actuator. In some embodiments, electric or hydraulic actuators may be preferred. In other embodiments, such as the embodiment illustrated in FIG. 16 and described above as utilizing a scissor mechanism, the preferred actuator 23 may be a ball screw actuator.

In some embodiments, the system may comprise more than one actuator 23. For instance, the embodiment illustrated in FIG. 21 contains multiple actuators 23, and more specifically two actuators. The multiple actuators 23 of the embodiment in FIG. 21 are placed side-by-side (i.e. having first ends along substantially the same horizontal plane and second ends along substantially the same horizontal plane) and are configured to operate in sync with one another. Accordingly, a user will activate the pair of actuators 23, which together will operate to bring the climbing wall 10 into a desired orientation. The use of multiple actuators 23 in this manner allows for a climbing surface having an increased width. More particularly, the use of multiple actuators 23 in this manner stabilizes the wall, such as by reducing the amount of torque placed on the wall when a user climbs to the upper corners of the wall.

In other embodiments, the system may comprise multiple independent climbing walls 10 operable on the same system using different actuators 23. For instance, each climbing wall 10 may be associated with one or more of the multiple actuators 23. In these embodiments, the actuator(s) 23 associated with each climbing wall 10 may operate independently from one another. In other words, a user may activate the actuator(s) 23 associated with a first climbing wall 10 independently from the actuator(s) associated with a second, adjacent climbing wall. This allows a user to bring a first climbing wall 10 to a first desired orientation, e.g. a desired degree of incline, and a second, adjacent climbing wall to a second desired orientation, e.g. a different desired degree of incline. The multiple climbing walls 10 may share a common base unit 21 and a common fixed frame element 63. Additionally, the multiple actuators 23 may be mounted to a common actuator support frame 65.

The actuator 23, itself, may be configured to only provide for movement within a permitted range. However, the system 20 may also comprise one or more limiting elements. The one or more limiting elements may define a permitted range of motion for the system 20. For example, the one or more limiting elements may prevent the climbing wall 10 from being inclined beyond about 40 degrees relative to the ground surface. Alternatively, the one or more limiting elements may prevent the climbing wall 10 from being inclined beyond about 45 degrees relative to the ground surface. Alternatively, the one or more limiting elements may prevent the climbing wall 10 from being inclined beyond about 50 degrees relative to the ground surface. The one or more limiting elements may comprise one or more limiting arms 35.

For example, in the embodiment illustrated in FIGS. 3-8, the first side posts 31 of the inner unit 24 and the outer unit 25 are linked by a first limiting arm 35 and the second side posts 32 of the inner unit and the outer unit are linked by a second limiting arm. A first end of the limiting arm 35 is fixedly attached to the side post 31, 32 of the outer unit 25. A second end of the limiting arm 35 comprises a channel. The side post 31, 32 of the inner unit 24 comprises a projection or other component that travels within the channel. Once the component of the inner unit 24 reaches the end of the limiting arm 35 channel, the inner unit 24 and the outer unit 25 are prevented from further movement in that direction. For instance, when the climbing wall 10 is in a substantially vertical orientation, such as is shown in FIG. 3, the component of the inner unit 24 may be positioned at one end of the channel. When the climbing wall 10 is in a fully inclined orientation, i.e. inclined to the maximum permitted angle, such as is shown in FIG. 4, the component of the inner unit 24 may be positioned at the opposite end of the channel. Accordingly, the length of the channels of the limiting arms 35 may define the permitted range of motion for the system 20. In alternative embodiments, the inner unit 24 may be fixedly attached to the limiting arm 35 and the outer unit may have a component that travels within the channel.

The embodiment illustrated in FIGS. 18-20 also comprises a limiting arm 35. In the illustrated embodiment, the limiting arm 35 has a first end attached to the actuator and a free second end. The limiting arm 35 extends downward from a position along the actuator 23. When the climbing wall 10 is in a substantially vertical position, as illustrated in FIG. 18, the free end of the limiting arm is positioned between the support wall 100 and the rear surface of the climbing wall. As the climbing wall 10 is inclined, the rotation of the actuator 23 about a hinged connection to the actuator support frame 65 causes the free end of limiting arm 35 to approach the support wall 100. When the climbing wall 10 is in a fully inclined orientation, i.e. inclined to the maximum permitted angle, such as is shown in FIG. 19, the free end of the limiting arm 35 is brought into contact with the support wall 100. Because further rotation of the limiting arm 35 is prevented by this contact, the actuator is prevented from further rotation. Although the shape and positioning of the limiting arm 35 shown in FIGS. 18-20 has been found to be effective, the limiting arm 35 may have different shapes and/or positioning and yet operate in the same or substantially the same manner.

The system 20 may also comprise additional, or backup, limiting elements. For example, the system 20 may comprise one or more backup cable 36. One end of the backup cable 36 may be attached, for instance, to the climbing wall 10, more particularly to the frame 14. For instance, the embodiment shown in FIG. 6 comprises a backup cable 36 that is attached to the upper end of the frame 14. The opposite end of the backup cable 36 may be mounted to the support wall 100. Accordingly, even if the actuator 23 and/or the limiting arms 35 were to fail, the climbing wall 10 would be suspended by the backup cable 36, and thereby prevented from falling to the ground surface. It is also contemplated that one or more cables 36 such as that shown in FIG. 6 could be used as the primary, as opposed to backup, limiting element.

Desirably, the actuator 23 may be automatically activated by a user through a relatively simple user interface. For example, the climbing wall 10 assembly may comprise at least one button, switch, lever, knob, etc., or any combination thereof. For instance, a user may depress a first button to cause the actuator 23 to extend and a second button to cause the actuator to retract. Or a user may pull a lever, turn a knob, flip a switch, etc. in one of two directions to cause the actuator to extend (first direction) or retract (second direction). Or a user may pull a lever, turn a knob, flip a switch, etc. in one of two directions to indicate which movement is desired, and then press a button to activate the actuator 23 and cause the movement to occur. Accordingly, in some embodiments, a user may bring the climbing wall 10 into and out of an inclined orientation with little to no physical exertion.

For example, the system 20 may comprise a user interface panel. The user interface panel may be mounted to the climbing wall 10, to the support wall 100 in the vicinity of the climbing wall, or to the base unit 21. Alternatively (or additionally), a user may activate the actuator using a remote control. The remote control may be connected to the system 20 via a cord or the remote control may be wirelessly connected to the system. A docking station for the remote control may be provided on the climbing wall 10, on the support wall 100 in the vicinity of the climbing wall, or on the base unit 21. In some embodiments, a user may activate the actuator remotely through a data processing unit, or processor, such as one associated with a personal computer, a tablet computer, a smartphone, or the like.

It is also contemplated that the actuator could be operated manually, such as through a variety of mechanical systems. For instance, manual activation may be included as a backup system, in case of failure of the automatic system, or it may be the primary system by which the actuator 23 is activated. When not in use, the climbing wall 10, may be stored in its substantially vertical orientation.

An example of a climbing wall in a substantially vertical orientation is shown in FIG. 3. In that embodiment, when a user activates the actuator 23, causing it to extend, extension of the actuator causes the inner unit 24 and the outer unit 25 to spread apart. This, in turn, causes the climbing wall 10 to tilt downward toward the ground surface, as shown for example in FIG. 4. Tilting of the climbing wall 10 may also cause the lower end of the frame 14 to rotate about its hinged connection with base unit 21. Tilting of the climbing wall 10 may also cause the inner unit 24 to rotate on the one or more wall mounts 28, the outer unit 25 to rotate about the frame 14 of the climbing wall, or both, thereby increasing the incline angle of the climbing wall.

By activating the actuator 23, a user may adjust the incline of the climbing wall 10 so that the climbing surface 13 is inclined at substantially any angle within the permitted range of movement of the system 20. In some embodiments, for example, the climbing surface 13 may be inclined at substantially any angle between about 90° (i.e. a substantially vertical orientation) and about 70° relative to a ground surface. Alternatively the climbing surface 13 may be inclined at substantially any angle between about 90° (i.e. a substantially vertical orientation) and about 65° relative to a ground surface. Alternatively the climbing surface 13 may be inclined at substantially any angle between about 90° (i.e. a substantially vertical orientation) and about 60° relative to a ground surface. Alternatively the climbing surface 13 may be inclined at substantially any angle between about 90° (i.e. a substantially vertical orientation) and about 55° relative to a ground surface. Alternatively the climbing surface 13 may be inclined at substantially any angle between about 90° (i.e. a substantially vertical orientation) and about 50° relative to a ground surface. Alternatively the climbing surface 13 may be inclined at substantially any angle between about 90° (i.e. a substantially vertical orientation) and about 45° relative to a ground surface.

In some embodiments, a user may also adjust the incline of the climbing wall 10 to bring the climbing surface 13 into a retraced position, such as is shown in FIG. 20. For instance, the climbing surface 13 may also be retracted within a permitted range of movement, i.e., the climbing surface 13 may be inclined at angles greater than about 90° (i.e. a substantially vertical orientation). For example, in some embodiments, the climbing surface may also be inclined at substantially any angle between about 90° (i.e. a substantially vertical orientation) and about 95° relative to a ground surface. Alternatively, the climbing surface may also be inclined at substantially any angle between about 90° (i.e. a substantially vertical orientation) and about 97° relative to a ground surface. Alternatively, the climbing surface may also be inclined at substantially any angle between about 90° (i.e. a substantially vertical orientation) and about 100° relative to a ground surface. Alternatively, the climbing surface may also be inclined at substantially any angle between about 90° (i.e. a substantially vertical orientation) and about 105° relative to a ground surface. As the angle increases in the retracted direction, the difficulty of the climbing wall 10 will be lessened, i.e. it will become easier for a beginner to climb the wall.

Once the climbing surface 13 has been placed at the desired angle, a user may simply deactivate the actuator 23. Because the system 20 employs a high-strength actuator 23, which is capable of withstanding forces placed on the climbing wall 10 during use in the inclined position, one or more users may enjoy the activities presented by the climbing wall without concern for unintended movement of the wall during use. When a user is finished using the climbing wall 10 at a desired angle of incline, a user may simply activate the actuator 23, causing it to retract.

In some embodiments, retraction of the actuator 23 causes the inner unit 24 and the outer unit 25 to come together. This, in turn, causes the climbing wall 10 to tilt upward toward its vertical orientation, as shown for example in FIG. 3. Tilting of the climbing wall 10 upward may also cause the inner unit 24 to rotate on the one or more wall mounts 28. For instance, in some embodiments, the actuator support structure 34 of the inner unit 24 may be moved into substantial alignment with the support wall 100, such as is shown in FIG. 3, which serves to minimize the footprint of the climbing wall 10.

Although the illustrated embodiments are shown as tilting between a substantially vertical orientation and a number of different inclined orientations, some embodiments of the climbing wall 10 may be configured to not obtain a substantially vertical orientation. For instance, in some embodiments, the climbing surface 13 may have an upper end to the range of angles to which it can be positioned that is 85° or less, 75° or less, 70° or less, or the like.

Because movement of the actuator 23 in either direction can be stopped and restarted at any time during movement of the climbing wall 10 to a more inclined orientation or to a less inclined orientation, fine-tune adjustments to the angle of inclination are easy to make. Moreover, because the climbing surface 13 may be placed at substantially any angle within a permitted range, a user may customize a climbing training program. For instance, if a user wants to gradually increase the difficulty of his or her climbing experience over time, a user can set the climbing wall at a 70 degree angle one week, and then set the climbing wall at a 68 degree angle the following week, a 66 degree angle the following week, and so on.

In some embodiments, a user may cause the system to change the incline of the climbing wall during use, i.e. while the user is engaged in a climbing activity. For instance, the system may be configured for a user to activate the actuator through a user interface positioned on the climbing surface and/or remotely while engaged in a climbing activity.

In some embodiments, the system may be configured to run one or more programs that automatically change the incline of the climbing wall during use. Each program may activate the actuator at predefined intervals, causing the incline of the climbing wall to increase or decrease at predetermined times during a climbing activity. In this way, a user may select a climbing program of a desired difficulty level, with the difficulty level being determined by the specific inclines of the treadmill and the defined intervals (the greater the inclines and the longer the intervals, the more difficult the climbing program).

For example, a climbing program may start with the wall in a substantially vertical position for two minutes, then activate the actuator to bring the wall to an 80 degree incline (a greater degree of difficulty) for a three-minute interval, then activate the actuator again to bring the wall to a 60 degree incline (an even greater degree of difficulty) for a ninety second interval, then activate the actuator to bring the wall back to an 80 degree incline for a one-minute interval, and activate the actuator a final time to bring the wall back to a substantially vertical position. In some embodiments, a user may select from a number of predetermined climbing programs and/or a user may create a custom climbing program.

The system may further comprise an output device, such as a speaker and/or a visual display that is visible from the climbing surface, which informs a user of an upcoming change in incline, the degree of incline achieved by the change, and/or of the amount of time that the wall will be maintained at the achieved incline before the next change occurs (e.g. a countdown).

In some embodiments, the climbing wall 10 may be provided with an angle indicator. For instance, the base unit 21 may comprise an angle indicator. Alternatively, an angle indicator may be positioned on or near the user interface. Moreover, the climbing wall 10 may be provided with a locking mechanism for locking the climbing wall at a desired angle. For instance, the base unit 21 may comprise a locking mechanism. Alternatively, a locking mechanism may be positioned on or near the user interface. Embodiments of the climbing wall 10 assembly may also comprise a workout panel 41. A workout panel 41 is a panel that is attached to the climbing wall 10 so as to extend above the climbing surface 13. However, rather than being aligned with the climbing surface 13, the workout panel 41 may be angled toward the support wall 100. Embodiments of climbing walls 10 having a workout panel 41 are shown in FIGS. 1, 3-4, and 9-10. By angling the workout panel 41 toward the support wall 100, the workout panel 41 may be configured to have a substantially vertical orientation when the climbing surface 13 is brought into an inclined orientation. For instance, in the embodiment shown in FIG. 4, the workout panel 41 is vertically oriented when the climbing surface 13 is brought to a maximum permitted angle of inclination, which in the illustrated example is about 50°, and which places the workout panel 41 in a vertical orientation when it is brought to its lowest height.

As shown in FIG. 10, the workout panel 41 may comprise a frame element 45 and a surface element 46. The frame element 45 may be affixed to the frame 14 of the climbing wall. The surface element 46 may be attached to the frame element 45 in the same manner that the one or more climbing panels 11 are attached to the frame. Desirably, the surface element 46 and the climbing surface 13 form a substantially continuous, gap-free surface, such as is shown in FIG. 1. Additionally, it may be desirable that the surface 46 has the same texture, color, and the like as the climbing surface 13, to provide visual and tactile consistency.

The workout panel 41 may comprise a number of different fitness accessories. For instance, the workout panel 41 may comprise a hang board, a chin-up bar, a mounting element for a suspension trainer and/or a resistance band, or a combination thereof. In the embodiment illustrated in FIG. 1, for example, the workout panel 41 comprises a hang board 61. A hang board 61 is an accessory configured for a user to grasp the board and suspend oneself, e.g. to hang in the air. One may also perform chin-ups/pull-ups or other exercises whilst grasping the hang board 61. Alternatively (or additionally), the workout panel 41 may comprise a conventional chin-up bar. By providing a hang board 61 or a chin-up bar which can be placed at varying heights, embodiments of the climbing wall 10 disclosed herein provide users of many different heights with equipment that may be positioned at an optimum height for performing exercises. The workout panel 41 or a hang board 61 may also comprise one or more mounting elements for a suspension trainer and/or a resistance band.

Suspension trainers employ a system of ropes or straps and involve supporting the body by anchoring to a point above the user's head. Suspension training allows a user to leverage his/her bodyweight and gravity to train for improved strength, balance, and core stability. A user can adjust his/her body position to increase or decrease resistance, making it a customizable workout for all fitness levels, from beginners to seniors to elite athletes. An example of a suspension system is the TRX Suspension Trainer line of equipment sold by Power Systems, a Play-Core® company. In many instances, suspension trainers must be mounted to an independent structure, which takes up valuable room space even when not in use. By providing an adjustable-incline climbing wall 10 with a mount for a suspension trainer, one may provide a mounting location for a suspension trainer that also serves a variety of other purposes and which takes up relatively little space when not in use. Moreover, by providing for the adjustment in the height of the mount, embodiments of the climbing wall 10 disclosed herein allow users of varying heights to achieve an optimal suspension training experience. In many instances, a mounting element for a suspension trainer may also be used as a mounting element for one or more resistance bands.

Embodiments of the climbing wall 10 may also comprise a training rope extending downward from an upper portion of the wall. The training rope could be attached to the climbing wall 10 in a variety of ways, including by an attachment to the frame, the climbing surface, or the workout panel 41, such as through the use of an I-bolt, a T-bolt, or the like. The training rope may be used in climbing or in various other exercises.

The workout panel 41 may also comprise one or more mounts for resistance bands. Resistance bands are used to perform a variety of exercises. The ability to vary the height of a mount for a resistance band also provides a benefit because many different exercises performed with resistance bands require the bands to be mounted at specific heights relative to a particular user.

Embodiments of the climbing wall 10 assembly may also comprise a wall extension panel 42. A wall extension panel 42 is a panel that is attached to the climbing wall 10 so as to extend the length of the climbing surface 13 beyond that formed by the one or more climbing panels 11. A climbing wall 10 is limited by the height of the ceiling in the room in which it is installed. However, when a climbing wall 10 is brought from a substantially vertical orientation to an inclined orientation, the top of the climbing wall is brought to a lower height, opening up additional space between the top of the climbing wall and the ceiling. When the climbing wall 10 is brought to an inclined orientation, a wall extension panel 42 enters this additional space, thereby providing the climbing wall 10 with a greater effective length.

Figure 5:
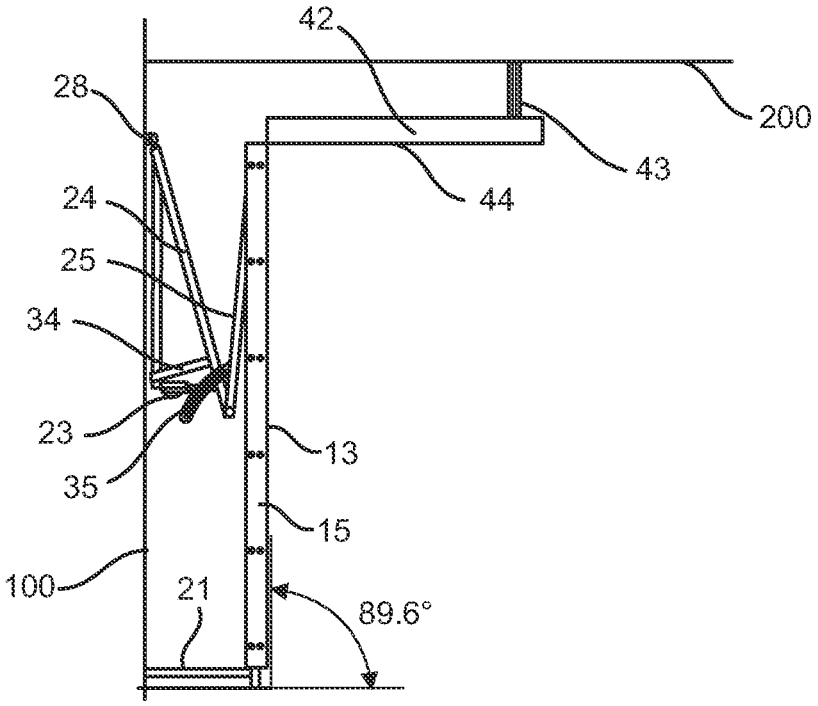
FIG. 5 is a side elevation view of an embodiment of a climbing wall of the present disclosure that includes a wall extension panel, showing the climbing wall in a substantially vertical orientation.
Figure 6:
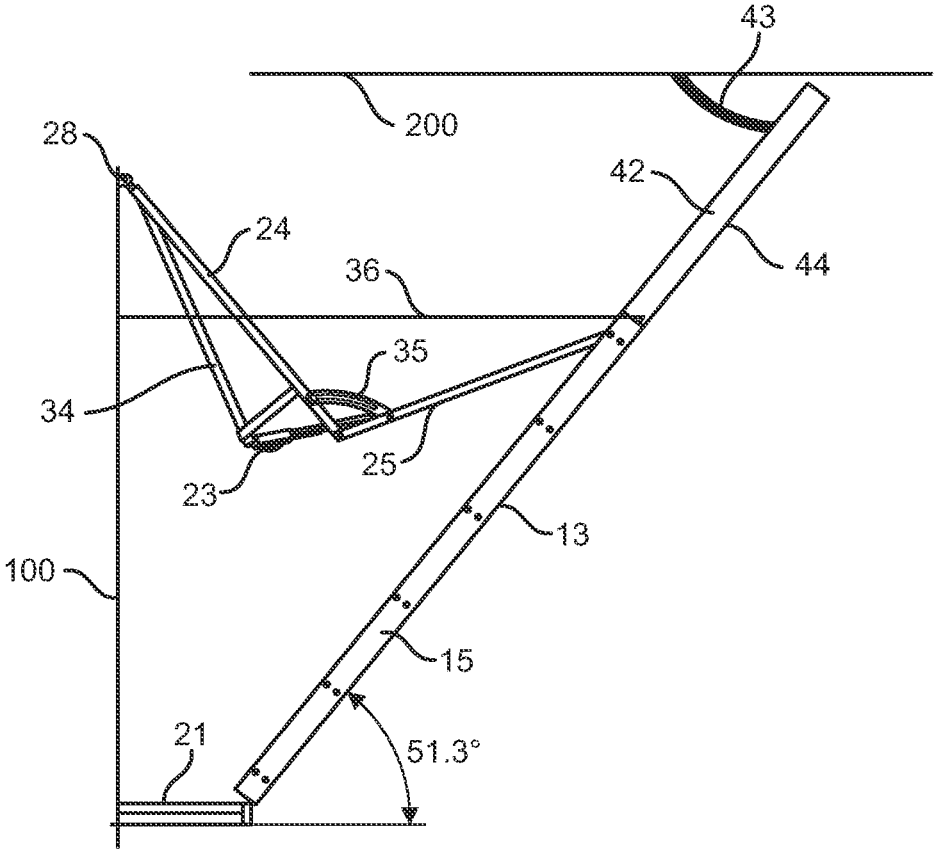
FIG. 6 is a side elevation view of an embodiment of a climbing wall of the present disclosure that includes a wall extension panel, showing the climbing wall in an inclined orientation.

An embodiment of a climbing wall 10 comprising a wall extension panel 42 is shown in FIGS. 5 and 6. As shown in FIG. 5, when the climbing wall 10 is in a substantially vertical orientation, the wall extension panel 42 is in a first position in which it is substantially parallel with the ground surface. When the climbing wall 10 is brought to a sufficiently inclined orientation, however, the wall extension panel 42 is brought into a second position in which the wall extension panel is at substantially the same angle as the climbing surface 13, as shown in FIG. 6.

The angle of incline necessary to bring the wall extension panel 42 from the first position into the second position may vary depending on the specific design of the climbing wall 10 assembly. In some embodiments, the wall extension panel 42 may be configured to move from the first position to the second position once the climbing wall is angled at 70° or less, relative to the ground surface, alternatively 65° or less, alternatively 60° or less, alternatively 55° or less, alternatively 50° or less. For instance, in some embodiments, the wall extension panel 42 may be in the second position when the climbing wall 10 is angled at 45°-50° relative to the ground surface, alternatively 50°-55°, alternatively 55°-60°, alternatively 60°-65°. In some embodiments, it may be desirable that the angle of incline necessary to bring the wall extension panel 42 to its second position is at or near the maximum permitted incline of the climbing wall 10. For instance, the embodiment in FIG. 6 is shown with the surface 44 of the wall extension panel 42 substantially aligned with the climbing surface 13 when the climbing wall 10 is at its maximum permitted incline.

When the climbing wall 10 is returned to a substantially vertical orientation, the wall extension panel 42 may be returned to the first position, in which it is substantially parallel with the ground surface (i.e. substantially perpendicular with the climbing surface).

The manner in which the extension panel 42 may be brought from the first position into the second position and from the second position back to the first position may vary. In the embodiment shown in FIGS. 5 and 6, for instance, the wall extension panel 42 is hingedly connected to the top of the climbing wall 10. More particularly, a bottom corner of the proximal end of the wall extension panel 42 is hingedly connected to the upper front corner of the climbing wall 10. By connecting the wall extension panel 42 to the climbing wall 10 in this manner, the surface 44 of the wall extension panel may be planar with the climbing surface 13 when the wall is brought to an inclined position. The hinged connection may be made in a variety of ways, as would be understood by one of skill in the art. Desirably, the hinge components are configured so that no hinge components are exposed on the climbing surface 13 or on the surface 44 of the wall extension panel 42 when the panel is aligned with the climbing surface for use.

The wall extension panel 42 may also be connected to the ceiling 200 of the room. For instance, the wall extension panel 42 may be connected to the ceiling 200 of the room by one or more connectors 43, such as cables, cords, or the like (other connectors may also be used, as would be understood by one of skill in the art). The one or more connectors 43 are attached to the wall extension panel 42 at or near its distal end and are configured to substantially fix the distal end of the wall extension panel 42 in place. With the distal end of the wall extension panel 42 substantially fixed in place, tilting of the climbing wall 10 into an inclined orientation causes the wall extension panel 42 to rotate about its hinged connection with the top of the climbing wall 10 so as to reach its second position. Similarly, tilting of the climbing wall 10 back toward a substantially vertical orientation causes the wall extension panel 42 to rotate about its hinged connection with the top of the climbing wall 10 so as to reach its first position.

Similarly to the workout panel 41 shown in FIG. 10 and described above, the wall extension panel 42 may comprise a frame element and a surface element. The frame element may be hingedly connected to the frame 14 of the climbing wall and the surface element may be attached to the frame element in the same manner that the one or more climbing panels 11 are attached to the frame. The surface element may be substantially the same (except perhaps in dimensions) as the one or more climbing panels 11 that form the climbing surface 13. In fact, the surface element functions as and may effectively be considered an additional climbing panel 11.

The surface 44 of the wall extension panel 42 comprises a plurality of climbing grips 12. The climbing grips 12 may be attached to the surface 44 of the wall extension panel 42 in the same manner that the climbing grips 12 are attached to the one or more climbing panels 11. Desirably, the climbing surface 13 and the surface 44 of the wall extension panel 42 form a substantially continuous, gap-free surface. Additionally, it may be desirable that the surface 44 of the wall extension panel 42 has the same texture, color, and the like as the climbing surface 13, to provide consistency throughout the length of the extended climbing surface 13, 42.

Embodiments of the climbing wall 10 may also comprise one or more protective cover 50 elements configured to conceal the moving parts of the system 20, so as to prevent interference with the movement of the parts that bring the climbing wall 10 between substantially vertical and inclined positions. In some embodiments, protective cover elements 50 may be positioned on each side of the system 20. In other embodiments, such as where the climbing wall 10 may be positioned near a wall or another piece of equipment that prevents access to the system 20, protective cover elements 50 may be positioned on only one side of the system 20.

Figure 8:
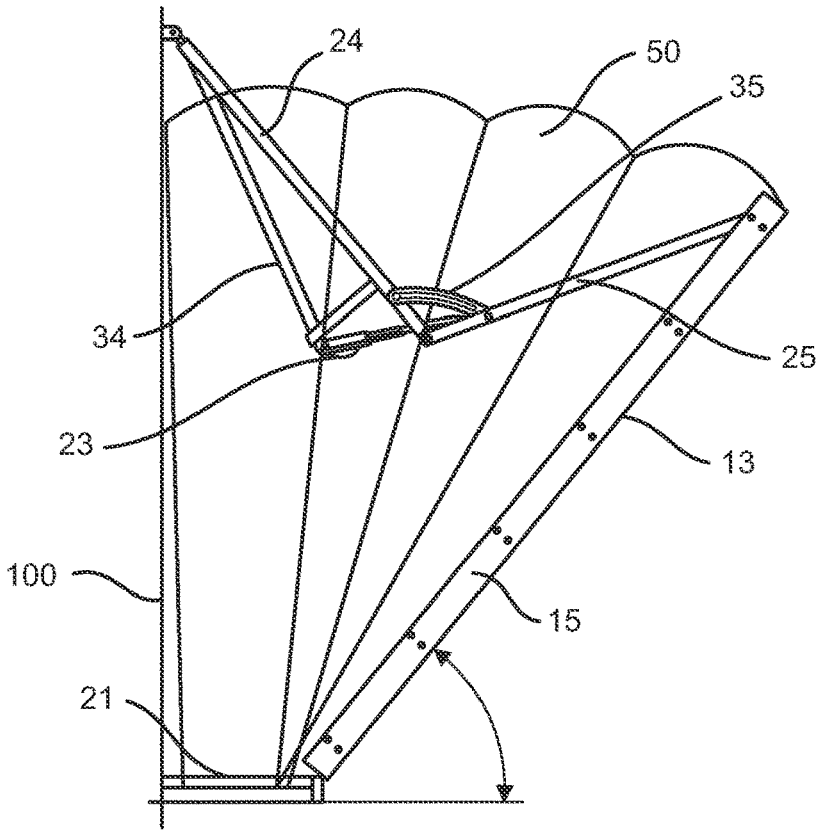
FIG. 8 is a side elevation view of an embodiment of a climbing wall of the present disclosure that includes a protective covering, showing the climbing wall in an inclined orientation with the protective covering expanded.

Each protective cover element 50 may span between the climbing wall 10 and the support wall 100. For instance, one end of a protective cover element 50 may be affixed to the frame 14 of the climbing wall and the other end of the protective cover element 50 may be mounted to the support wall 100. The protective cover element 50 may span the entire height of the climbing wall 10, such as is shown in FIG. 8, although it may also span only to such a height as is desired to effectively prevent access to the moving parts of the system 20.

The protective cover elements 50 may take any of a variety of configurations. In some embodiments, for instance, each protective cover element 50 may be designed to fold in on itself when the climbing wall 10 is in a substantially vertical orientation and to fan out when the climbing wall is moved to an inclined orientation. For example, the protective cover elements 50 may expand in an accordion-like manner, as shown in FIG. 8. This provides the climbing wall 10 assembly with a streamlined appearance when in the substantially vertical orientation.

The climbing wall 10, and more particularly the climbing surface 13, may also comprise one or more fitness accessories. For instance, in some embodiments, one or more of the climbing grips 12 may also be configured to permit a user to enhance workout activities using the climbing wall 10. Examples of fitness accessories of this sort are described in co-owned U.S. Pat. No. 7,780,576 B1, the entirety of which is incorporated by reference. For instance, the climbing surface 13 may include one or more hand holds and/or step holds configured to receive a resistance band 62.

The climbing surface 13 may include one or more mounts configured to receive a resistance band (including those that are not configured to also serve as hand and/or step holds). The climbing surface 13 may also include one or more anchors for a fitness rope. Fitness ropes, sometimes also called training ropes, workout ropes, weighted ropes, or battle ropes provide a low impact activity that can be used to increase strength and performance. Examples of training ropes include those sold by Power Systems, a PlayCore® company. In some cases, the same component may be configured to receive a resistance band and anchor a fitness rope. The climbing surface 13 may also include one or more mounting elements for suspension training, as have already been described in detail with respect to an additional workout panel 41.

The climbing surface 13 may include one or more components that extend from the surface and have a flat top surface. These flat top components may be configured to be used as a step, a seat, or the combination thereof, by a user when performing a variety of exercises. The flat top components can also be configured for a person to support their upper body by placing their hands on the flat surfaces, palm side down, when performing a variety of exercises, such as tricep dips and the like. For instance, in some embodiments, two flat top components may be mounted to the climbing surface at substantially the same height and separated from one another by a distance of about 1 to about 2.5 feet, more desirably about 1.5 to 2 feet. These flat top components may also be inverted and mounted at the bottom of the climbing wall 10 to provide a downward-facing surface for a user to maintain his/her feet in contact with the ground when performing a variety of exercise, such as sit ups, curls, and the like.

Because the height of these accessories can be adjusted by increasing or decreasing the angle of the climbing wall 10, users of varying heights may be able to place the fitness accessories at an optimum height for a person of their specific height. Embodiments of the climbing wall 10 may therefore include any number of the fitness accessories described herein, including any combinations of the fitness accessories described herein.

In some embodiments, the climbing wall 10 may also comprise a plurality of lights on the climbing surface 13. For example, the climbing surface 13 may contain a small LED light adjacent to, and visually associated with, each climbing grip 12 or aperture to which a climbing grip may be attached. Therefore, a preset climbing route may be designated through control over which lights are illuminated. Notably, the ability of a system to automatically adjust the incline of the climbing wall 10 in combination with the ability of the system to illuminate a preset climbing route allows for a user to select from countless climbing challenges, such as may be stored in a database. Upon selection of a climbing challenge, the system may both (a) cause the actuator to bring the wall to the specific incline associated with the selected climbing challenge and (b) illuminate the lights associated with the grips that are used in the climbing route associated with the selected climbing challenge. In some embodiments, a user may also create a new climbing challenge, having both a designated incline aspect and a signified climbing route aspect, which may then be stored in the climbing challenge database.

In some embodiments of the climbing wall 10 disclosed herein, one or more of the climbing grips 12 may be easily attachable to and removable from the climbing surface 13. In some embodiments, for example, all of the climbing grips 12 may be easily attachable to and removable from the climbing surface 13. Similarly, one or more of the fitness accessories may be easily attachable to and removable from the climbing surface 13. In some embodiments, for example, all of the fitness accessories may be easily attachable to and removable from the climbing surface 13. In these embodiments, no tools are necessary to replace a first climbing grip 12 or fitness accessory with a second climbing grip or fitness accessory. In this way, one may arrange a series of climbing grips 12 and/or fitness accessories on the climbing surface 13 in a desired configuration for a particular use. One may also remove the climbing grips 12 and/or fitness accessories from the climbing surface 13, such as if one wanted to ensure that the climbing wall 10 would not be usable without supervision.

The climbing grips 12 and/or fitness accessories may have a number of configurations which render them easily attachable to and removable from the climbing surface 13. It is important, however, that the climbing grips 12 and/or fitness accessories are not accidentally dislodged from the climbing surface 13 during use.

Accordingly, in some embodiments, the climbing grips 12 and/or fitness accessories may be configured so that they must be moved in a pathway through multiple different directions prior to removal from the climbing surface. For instance, in some embodiments, a climbing grip 12 (or fitness accessory) may be removable from the climbing surface 13 by sliding it vertically through a first portion of a defined pathway, followed by sliding it horizontally through a second portion of a defined pathway, followed by pulling the climbing grip away from the climbing surface.

Figure 12:
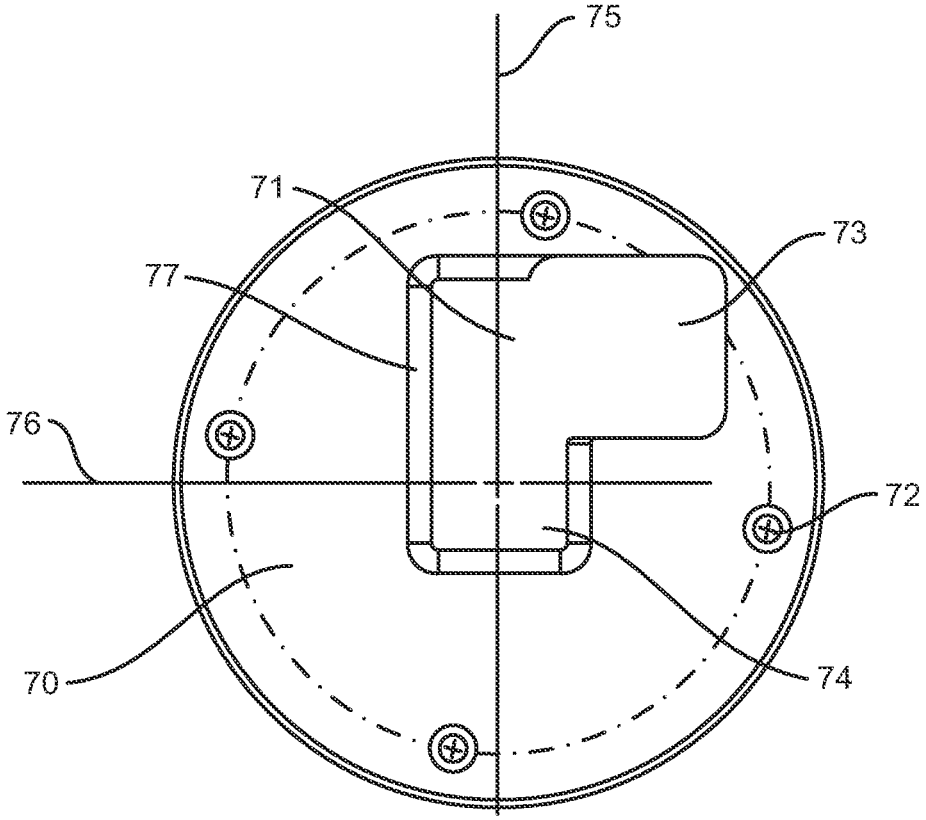
FIG. 12 is front elevation view of an embodiment of a mounting plate for easily insertable and removable climbing grips.

In some embodiments, for instance, the climbing surface may comprise a plurality of mounting plates 70. Each mounting plate 70 may comprise an aperture 71 configured to receive and securely engage a tab 80. The tab may be attached to a climbing grip 12 and/or a fitness accessory. An embodiment of a mounting plate 12 is illustrated in FIG. 12. Although the mounting plate 70 in the illustrated embodiment is circular, the mounting plate 12 may take on any number of shapes and sizes. The mounting plate 70 may be secured to one of the one or more climbing panels 11, 44 through any number of conventional fasteners. For instance, the mounting plate 70 desirable has one or more through-holes 72 configured for the attachment of one or more fasteners. In the illustrated embodiment, for instance, the mounting plate 70 comprises four through-holes 72 located around the circumference of the mounting plate, which ensures a secure connection between the mounting plate and the climbing surface 13. Although the aperture 71 in the illustrated embodiment is square, the aperture may also take on any number of shapes or sizes. It is desirable, however, that the aperture 71 and the periphery of the tab 80 have substantially the same shape.

The aperture 71 comprises at least a first portion 73 and a second portion 74. The first portion 73 of the aperture is configured to receive the tab 80. The second portion 74 is configured to securely engage the tab 80. The first portion 73 and the second portion 74 are desirably offset from one another so that the tab must be slid in more than one direction in order to move between the first and second portions 73, 74. For instance, it is desirable that the tab must be slid through the aperture in at least two different directions in order to move between the first and second portions 73, 74 of the aperture 71, alternatively at least three different directions.

In some embodiments, the second portion 74 of the aperture 71 may be positioned at or near the center of the mounting plate 70. The first portion 73 of the aperture 71 may be positioned toward the top and to one side (to the right in the illustrated embodiment) of the mounting plate 70. The pathway between the first portion 73 and the second portion 74 of the aperture 71 therefore requires a first sliding movement toward the central vertical axis 75 of the mounting plate 70 (e.g. a horizontal or sideways movement) and second sliding movement toward the central horizontal axis 76 of the mounting plate (e.g. a vertical movement downward). However, other arrangements are also contemplated without departing from the scope of the present disclosure. For instance, in some embodiments, the pathway between the first portion 73 and the second portion 74 of the aperture may require a first sliding movement toward the central horizontal axis 76 (e.g. downward), a second sliding movement toward the central vertical axis 75 (e.g. sideways), and a third sliding movement toward the central horizontal axis (e.g. downward).

The tab 80 is affixed to a climbing grip 12 and/or a fitness accessory. The tab 80 is configured to access a first portion of the aperture 73 and to securely engage with a second portion of the aperture 74. In this manner, one may position a climbing grip 12 and/or fitness accessory at a desired location on the climbing surface 13 by first inserting the tab 80 into the first portion 73 of an aperture 71 of a desirably located mounting plate 70 and then moving the tab into the second portion of the aperture 74 in order to secure the climbing grip and/or fitness accessory to the mounting plate. Desirably, after inserting the tab 80 into a first portion of the aperture 73, one may slide the tab through a pathway, such as those described above, between the first portion of the aperture and the second portion of the aperture 74, in order to bring the tab into secure engagement with the mounting plate 70.

Figure 13:
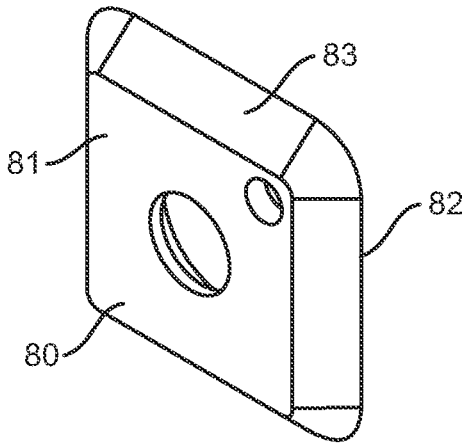
FIG. 13 is a front perspective view of a tab for easily insertable and removable climbing grips.

An embodiment of a tab 80 is illustrated in FIG. 13. The tab 80 may be configured for attachment to the rear surface of a climbing grip 13 and/or fitness accessory. Alternatively, the tab 80 may be integral with a climbing grip 13 and/or fitness accessory. The tab 80 shown in FIG. 13 is configured to access and securely engage with the aperture 71 of the mounting plate 70 shown in FIG. 12. The tab 80 may be wider at or near its rear surface 82 than at its front surface 81. The first portion of the aperture 73 may be configured to accept the wider rear surface 82 of the tab 80 while the second portion of the aperture 74 may be configured so that the wider rear surface 82 of the tab is positioned behind a portion of the mounting plate 70 that defines the periphery of the aperture 71 and thereby secured within the aperture 71.

The tab 80 and the mounting plate 70 may also be configured so that the tab 80 may be easily, yet securely, slid within the aperture 71 between the first portion 73 and the second portion 74. In some embodiments, for example, as shown in the embodiment illustrated in FIG. 13, the periphery of the tab 80 may comprise a sloping or chamfered edge portion 83 that slopes outward from the front surface 81 to the rear surface 82. The mounting plate 70 may comprise a counter-sloped edge portion 77 along the rear periphery of at least part of the aperture, and desirably along the pathway between the first portion 73 and the second portion 74 of the aperture. In this way, the sloped edge portion 83 of the tab 80 may correspond with the counter-sloped edge portion of the mounting plate 77 once the tab is moved out of the first portion of the aperture 73. The interaction of the sloped edge portion 83 of the tab and the counter-sloped edge portion of the mounting plate 77 provides for a secure but slidable movement of the tab 80 within the aperture 71 and into engagement with the second portion of the aperture 74.

Figure 14:
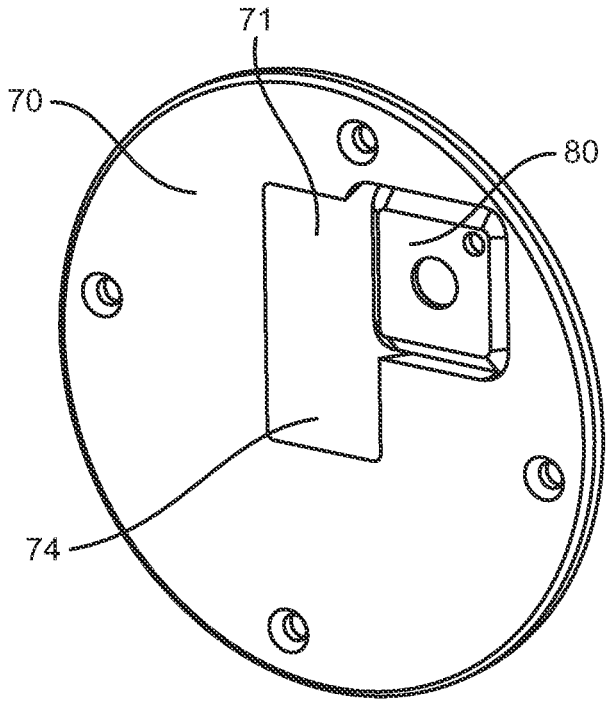
FIG. 14 is a front perspective view of an assembly for easily insertable and removable climbing grips showing a tab in the first portion of the mounting plate aperture.
Figure 15:
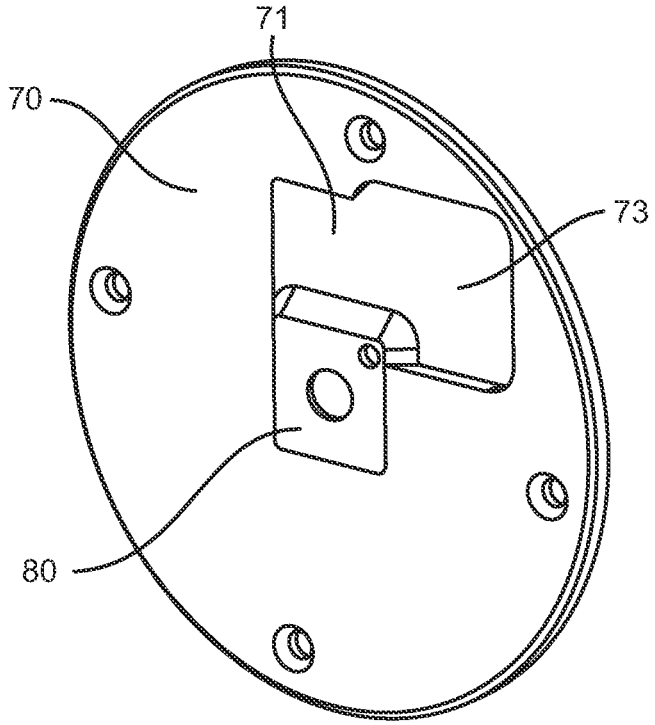
FIG. 15 is a front perspective view of an assembly for easily insertable and removable climbing grips showing a tab in the second portion of the mounting plate aperture.

The relationship between an embodiment of a tab 80 and an embodiment of a mounting plate 70 is shown in FIGS. 14 and 15. In FIG. 14, the tab 80 has been inserted into the first portion 73 of the aperture 71. In FIG. 15, the tab 80 has been securely positioned within the second portion 74 of the aperture 71. To mount a climbing grip 12 and/or fitness accessory to the climbing surface 13, therefore, one may simply insert the tab 80 into the first portion of the aperture 73, as shown in FIG. 14, and then slide the tab through the pathway defined by the aperture 71 until it reaches the second portion of the aperture 74, as shown in FIG. 15. To remove a climbing grip 12 and/or fitness accessory from the climbing surface 13, one may simply follow the reverse steps. For instance, one may simply slide the tab 80 out of the second portion of the aperture 74, shown in FIG. 15, through the pathway defined by the aperture 71 until it reaches the first portion of the aperture 73, as shown in FIG. 14, at which position the tab may be removed from the aperture.

The removable climbing grips 12 described above are contemplated for use in any climbing wall and are not limited to the adjustable-incline climbing walls 10 described herein.

Figure 23:
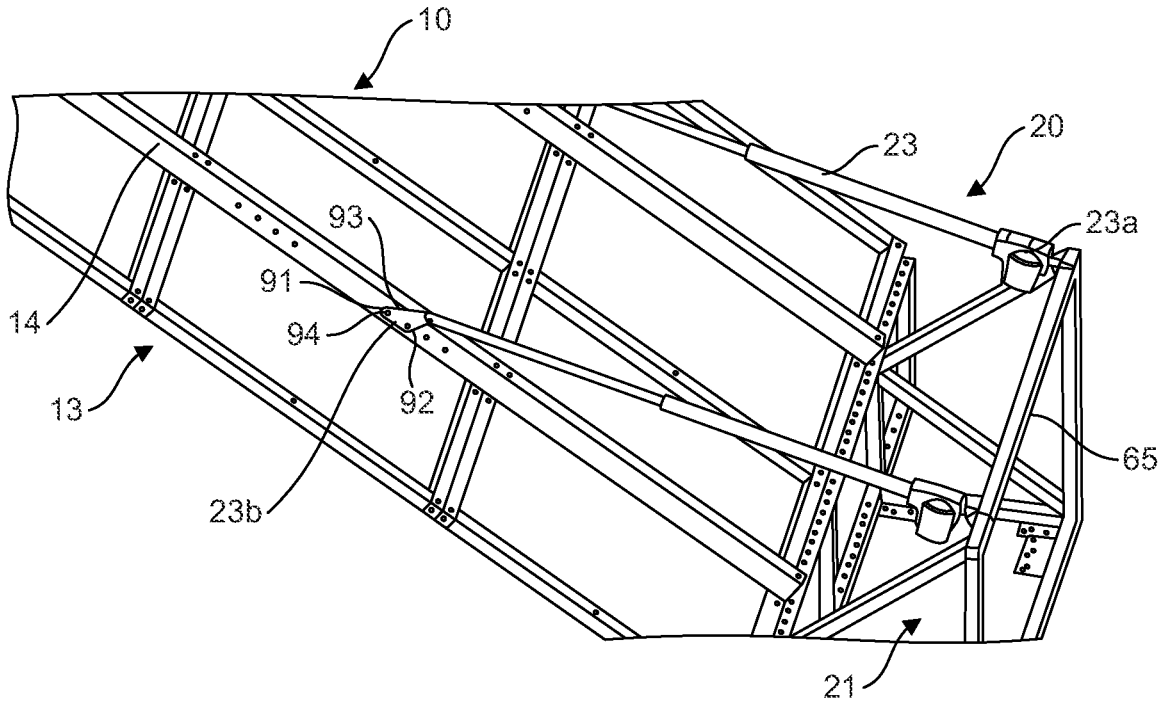
FIG. 23 is a rear perspective view of an embodiment of a climbing wall of the present disclosure, showing a first actuator attachment position.
Figure 24:
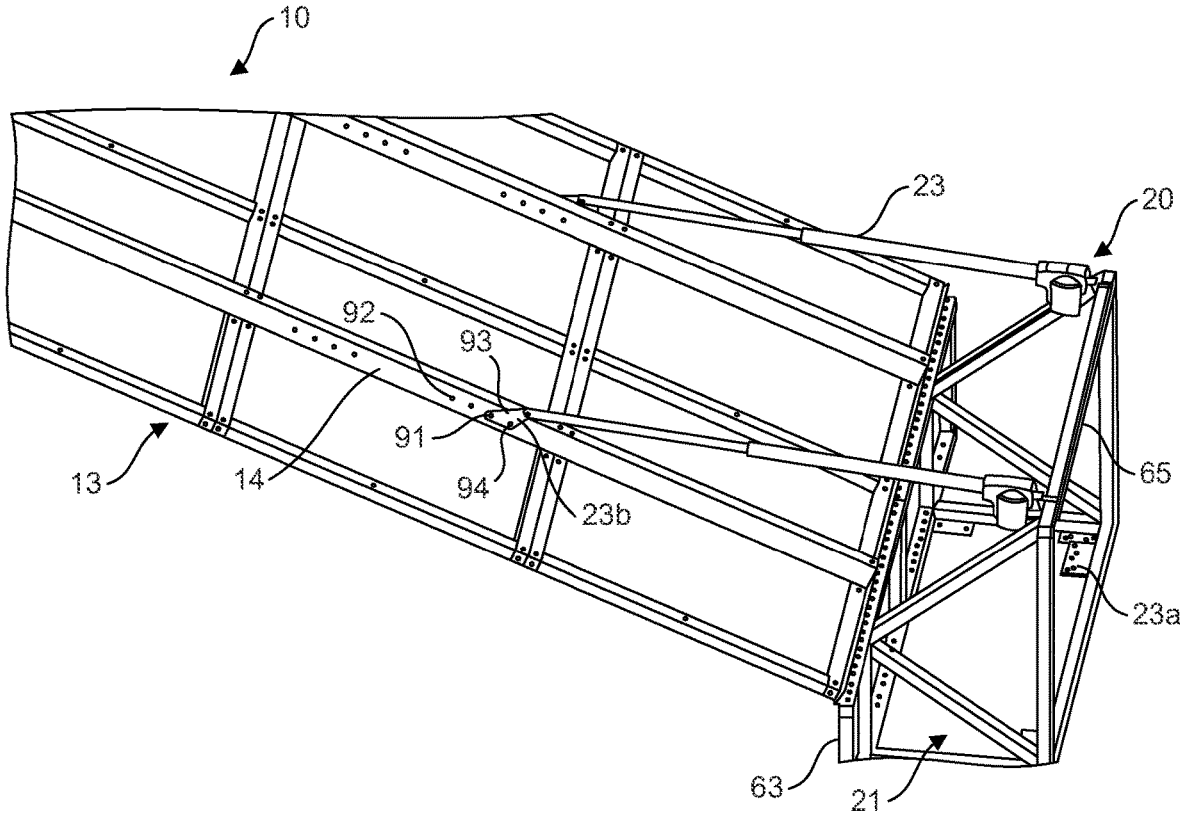
FIG. 24 is a rear perspective view of an embodiment of a climbing wall of the present disclosure, showing a second actuator attachment position.

An additional feature of an adjustable-incline climbing wall 10 such as those described herein is shown in FIGS. 23 and 24. Namely, in some embodiments, the adjustable-incline climbing wall 10 may comprise an actuator 23 that has an adjustable connection with at least one of the wall frame 14 and the base unit 21. For efficiency, the embodiment in which the connection between the actuator 23 and the wall frame 14 is adjustable is described and shown herein. However, it is to be recognized that an alternative (non-illustrated) embodiment in which the connection between the actuator 23 and the base unit 21 is adjustable is also contemplated as falling within the scope of the present disclosure. For instance, the first end of the actuator 23 could be attached to the base unit 21 at a number of different vertical positions so as to provide the same effects described herein. Moreover, the specific disclosures relating to an adjustable connection between the actuator 23 and the wall frame 14 may be equally applicable to an adjustable connection between the actuator and the base unit 21.

In some embodiments, the actuator 23 may comprise a first end 23*a* and a second end 23*b*. The first end 23*a* of the actuator 23 may be connected to the base unit 21. More particularly, the first end 23*a* of the actuator 23 may be connected, e.g. hingedly connected, to the actuator support frame 65. The second end 23*b* of the actuator 23 may be connected, e.g. hingedly connected, to the wall frame 14.

The connection between the actuator 23 and the wall frame 14 may be adjustable, such that the second end 23*b* of the actuator may be moved between a first actuator attachment position, such as that shown in FIG. 23, and a second actuator attachment position, such as that shown in FIG. 24.

In addition, or alternatively, the connection between the actuator 23 and the base unit 21 may be adjustable, such that the first end 23*a* of the actuator 23 may be moved between a first actuator attachment position and a second actuator attachment position. Although not illustrated, this may be achieved, for instance, by providing the base unit 21 (and more particularly the actuator support frame 65) with an additional vertical railing comprising a plurality of attachment points, such that the connection between the first end 23*a* of the actuator 23 and the actuator support frame 65 may be achieved at a plurality of elevations above the ground surface. The specific mechanisms by which the attachment may be adjusted are the same as those described herein with respect to an adjustable attachment between the actuator 23 and the wall frame 14.

In some embodiments, the actuator may be adjusted between a first actuator attachment position and a second actuator attachment position indirectly. For instance, rather than the attachment point of the actuator itself being moved or repositioned along the wall frame, the base unit, or both, in some embodiments an element of the wall frame and/or an element of the base unit may be moved so as to have the same general effect. For instance, in some embodiments, a portion of the actuator support frame 65 may be moved vertically between at least first and second positions, by which the first end 23*a* of the actuator 23 would achieve a plurality of elevations above the ground surface despite the attachment point between the actuator and the base unit not changing. Similarly, a wall frame element to which the second end 23*b* of the actuator 23 is attached, e.g. a crossbar element (not illustrated) may be move relative to the rest of the wall frame 14 to achieve the same effect. As with the other embodiments disclosed herein, such an indirect repositioning could be achieved manually and/or electronically. Unless otherwise stated, such an indirect repositioning is contemplated as satisfying any limitation that the connection between the actuator and one or more of (i) the wall frame and (ii) the base unit be adjustable such that the actuator may be adjusted between a first actuator attachment position and a second actuator attachment position.

Notably, the permitted range of angles to which the climbing surface 13 may be brought will differ between the first actuator position and the second actuator position. In this way, the climbing wall 10 may be configured so that the climbing surface 13 may be provided with a greater range of potential incline angles than may otherwise be possible using a single actuator attachment position.

In some embodiments, for example, by combining the first range of permitted incline angles through which the climbing surface 13 may be inclined when the actuator 23 is in the first actuator attachment position with the second range of permitted incline angles through which the climbing surface may be inclined when the actuator is in the second actuator attachment position, the climbing surface may be positioned at substantially any angle of incline between 0° and 50° relative to a vertical axis (between 90° and 40° relative to the ground), alternatively any angle of incline between 0° and 55° relative to a vertical axis (between 90° and 35° relative to the ground), alternatively any angle of incline between 0° and 60° relative to a vertical axis (between 90° and 30° relative to the ground), alternatively any angle of incline between 0° and 65° relative to a vertical axis (between 90° and 25° relative to the ground), alternatively any angle of incline between 0° and 70° relative to a vertical axis (between 90° and 20° relative to the ground), alternatively any angle of incline between 0° and 75° relative to a vertical axis (between 90° and 15° relative to the ground).

For example, the first permitted range of incline angles, i.e. the range of angles that may be achieved when the actuator 23 is in the first actuator attachment position, may comprise between 0° and 35° relative to a vertical axis, alternatively between 0° and 40° relative to a vertical axis, alternatively between 0° and 45° relative to a vertical axis, alternatively between 0° and 50° relative to a vertical axis, alternatively between 0° and 55° relative to a vertical axis, alternatively between 0° and 60° relative to a vertical axis. The second permitted range of incline angles, i.e. the range of angles that may be achieved when the actuator 23 is in the second actuator attachment position may comprise up to 55° relative to a vertical axis, alternatively up to 60° relative to a vertical axis, alternatively up to 65° relative to a vertical axis, alternatively up to 70° relative to a vertical axis, alternatively up to 75° relative to a vertical axis. In order to achieve the higher incline angles recited above, the lower end of the second permitted range of incline angles will generally be greater than 0° relative to a vertical axis—meaning that when the actuator 23 is in the second actuator attachment position, the climbing surface 13 may not be brought into a vertical position. However, that is relatively unimportant, because the actuator 23 can simply be moved back to the first actuator attachment position in order to bring the climbing surface 13 to a vertical position. In some embodiments, the lower end of the second permitted range of incline angles may be about 5° relative to a vertical axis, alternatively about 10° relative to a vertical axis, alternatively about 15° relative to a vertical axis, alternatively about 20° relative to a vertical axis, alternatively about 25° relative to a vertical axis.

In some embodiments, the climbing wall 10 may be configured so that the first actuator attachment position and the second actuator attachment position may be associated with the difficulty of the climbing experience (as higher angles relative to vertical provide a more difficult climb). For instance, the first actuator attachment position may be identified as providing incline angles having a first degree of difficulty and the second actuator attachment position may be identified as providing incline angles having a second degree of difficulty, the second degree of difficulty being different from the first degree of difficulty. For example, the second actuator attachment position may be identified as "high difficulty," "expert only," or some equivalent designation. In contrast, the first actuator attachment position may be identified as "beginner" or "standard" difficulty, or some equivalent designation.

In some embodiments, the climbing wall 10 may be configured to have more than two different actuator attachment positions. For instance, in some embodiments, the climbing wall 10 may comprise three (or more) actuator attachment positions. The range of incline angles associated with the third actuator attachment position, i.e. the third permitted range of incline angles, may differ from both the first permitted range of incline angles and the second permitted range of incline angles. Similar to the above, the third actuator attachment position may also be identified as providing incline angles having a third degree of difficulty. For instance, the first actuator attachment position may be identified as "beginner" or "standard" difficulty (or some equivalent designation), the second actuator attachment position may be identified as "intermediate" or "medium" difficulty (or some equivalent designation) and the third actuator attachment position may be identified as "high" difficulty or "expert" (or some equivalent designation).

In addition to providing the climbing surface 13 with a greater range of incline angles, the use of multiple actuator attachment positions may also provide for a climbing facility to exert an enhanced degree of control over the angles to which the climbing surface may be brought. For instance, in some embodiments, the climbing wall 10 may be configured so that the actuator 23 is lockable in one of the actuator attachment positions. For example, the actuator 23 may be locked in the first actuator attachment position as to limit the permitted incline of the climbing surface 13.

The climbing wall 10 may be configured for the connection between the actuator 23 and the wall frame 14 to be adjusted by any manner. In some embodiments, for instance, the connection between the actuator 23 and the wall frame 14 may be adjusted by (i) loosening or removing one or more fasteners 91 that secure the second end 23*b* of the actuator to the wall frame, (ii) moving the second end of the actuator to a different position on the wall frame, and (iii) tightening or replacing the one or more fasteners to secure the second end of the actuator to the wall frame. For instance, the wall frame 14 may comprise a plurality of apertures 92 configured to receive a fastener 91. Similarly, the second end 23*b* of the actuator 23 may comprise a mounting plate 93 having one or more apertures 94 configured to receive a fastener 91.

In some embodiments, one or more fasteners 91 may be removed from one or more pairs of aligned apertures 92, 94 and the second end 23*b* of the actuator 23 may be moved such that aperture(s) 94 aligns with an aperture(s) 92 located at a different position along the wall frame 14. The one or more fasteners 91 may be replaced through newly aligned apertures 92, 94 to secure the actuator 23 is a new actuator attachment position. The one or more fasteners may be selected from any fastener suitable to secure the second end 23*b* of the actuator 23 to the wall frame 14, including for example a pin (e.g. as might be found on a weight-lifting machine), a bolt, a clip or shackle (e.g. a carabiner), or the like. As noted above, in some embodiments, at least one of the one or more fasteners 91 may be locked in place.

In other embodiments, the one or more fasteners 91 need not be removed from aligned apertures 92, 94 in order to move the actuator 23 from a first attachment position to a second attachment position. Rather, in some embodiments, the one or more fasteners 91 need only be loosened. In some embodiments, for instance, the apertures 92 may be linked to one another by a slot through which the fastener(s) 91 may slide from a first one of apertures 92 to a second one of apertures 92. Thus, one need only loosen the one or more fasteners 91 sufficiently to slide the second end 23*b* of actuator (including attached fasteners 91) between the first and second aperture 92. The slot may be offset from the apertures 92, such that the second end 23*b* of actuator 23 must be slide in a first direction (e.g. upward) out of a first aperture 92 before it can be slide in a second direction through the slot. Once the fastener 91 reaches a second aperture 92, the second end 23*b* of actuator 23 can be moved in the opposite of the first direction (e.g. downward) such that fastener 91 enters the second aperture, whereby the fastener 91 can be secured to the wall frame 14. In these embodiments, fastener 91 need not be a separate component from the actuator 23. Rather, fastener 91 may be an element that projects from the second end 23*b* of the actuator 23 and which is configured to slide within the slot between apertures 92.

Other manners of connecting the actuator 23 to the wall frame 14, as would be easily understood by persons of skill in the art, are also contemplated without departing from the scope of the present invention.

In some embodiments, the connection between the actuator 23 and the wall frame 14 may be adjusted automatically, e.g. through and electronic control. For instance, an operater may use an electronic control unit not only to adjust the incline of climbing surface 13 within a permitted range of incline angles, but also to adjust the connection between the actuator 23 and wall frame 14 between a first actuator attachment position and a second actuator attachment position. In this way, movement of the climbing surface 13 between a first permitted range of incline angles and a second permitted range of incline angles may be performed seamlessly. For example, the second end 23*b* of actuator 23 may be configured to travel along the wall frame 14 in a continuous or semi-continuous manner as the incline angle of the climbing surface 13 is moved across the boundary of a first permitted range and a second permitted range. Thus, the climbing surface 13 may be moved within the combined range of permitted incline angles, without an operator even necessarily knowing that the second end 23*b* of actuator 23 was moved from a first actuator attachment position to a second actuator attachment position. As described previously, the electronic control unit may be attached to the climbing wall 10 structure or may be a remote control. In some embodiments, the electronic control unit may be a personal computer, tablet computer, or smartphone.

In those embodiments in which the connection between the actuator 23 and the actuator support frame 65 is adjustable, the elevation of the actuator support frame may itself be adjusted, such as through the one or more vertical posts comprising a telescoping element. For instance, in some embodiments having a base unit 21 design similar to that illustrated in FIGS. 23-24, the cross-member to which the actuator 23 is mounted may be raised or lowered by telescoping of the vertical posts that support it. As with the other adjustments described herein, this may be achieved manually or electronically.

In some embodiments, such as that illustrated in FIGS. 23-24, the system 20 for adjusting the incline of the climbing surface 13 may comprise a plurality of actuators 23. Each of the plurality of actuators 23 may have a first end 23*a* connected to the base unit 21 and a second end 23*b* connected to the wall frame 14. The connection between each actuator 23 and the wall frame 14 may be adjustable such that each actuator may be adjusted between a first actuator attachment position, e.g. shown in FIG. 23, and a second actuator attachment position, e.g. shown in FIG. 24.

A number of actuators 23 may be operatively linked such that they are adjusted between a first actuator attachment position and a second actuator attachment position together (i.e. movement of a first actuator 23 is brought about at the same time as movement of a second actuator). In this way, climbing surface 13 may easily be transitioned between a first permitted range of incline angles and a second permitted range of incline angles.

In alternative embodiments, each of the plurality of actuators 23 may be independently operated. In this way, the climbing wall 10 may comprise multiple independently operated climbing surfaces 13, which can each be placed at an angle of incline that is independent from an adjacent climbing surface. These independent climbing surfaces may also be thought of as portions of a single climbing surface. Accordingly, a first actuator 23 may be operated to place a first climbing surface 13 or portion of climbing surface at a first angle of incline and a second actuator may be operated to place a second climbing surface or portion of climbing surface at a second angle of incline, wherein the first and second angles of incline differ from one another.

As many linked and/or independent actuators 23 may be used in any particular climbing wall 10 to provide a climbing surface 13 having a desired size—i.e. width—and operation.

It can be seen that the described embodiments provide a unique and novel climbing wall 10 that has a number of advantages over those in the art. While there is shown and described herein certain specific structures embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An adjustable-incline climbing wall comprising:

a. one or more climbing panels configured to provide a climbing surface;

b. a plurality of climbing grips affixed to the climbing surface;

c. a wall frame supporting the one or more climbing panels;

d. a system for adjusting an incline of the climbing surface, the system comprising:

i. a support assembly comprising:

a base unit having a first end and a second end, a fixed frame element that hingedly supports a lower edge of the wall frame, wherein the fixed frame element comprises a front surface which provides a lower, fixed portion of the climbing surface, and an actuator support frame; and ii. one or more actuators configured to adjust the incline of the wall frame so that the climbing surface is positionable at a plurality of incline angles;

wherein a first end of each of the one or more actuators is connected to the actuator support frame and a second end of each of the one or more actuators is connected to the wall frame;

wherein the actuator support frame supports the first end of each of the one or more actuators in a raised position relative to a ground surface on which the support assembly rests;

wherein the connection between each of the one or more actuators and one or more of (i) the wall frame and (ii) the actuator support frame is adjustable, such that each of the one or more actuators is movable between a first actuator attachment position and a second actuator attachment position by adjusting a position of the connection of the second end of each of the one or more actuators along a vertical rail of the wall frame and/or by vertically adjusting an elevation of the raised position of the first end of each of the one or more actuators relative to the ground surface;

wherein a first permitted range of incline angles is provided when the one or more actuators is in the first actuator attachment position and a second permitted range of incline angles is provided when the one or more actuators is in the second actuator attachment position, the second permitted range of incline angles being different from the first permitted range of incline angles; and wherein each of the one or more actuators is a linear actuator configured to extend or retract to position the climbing surface at one of the plurality of incline angles.

2. The adjustable-incline climbing wall of claim 1, wherein the connection between each of the one or more actuators and the wall frame is adjustable.

3. The adjustable-incline climbing wall of claim 2, wherein the connection between each of the one or more actuators and the wall frame is configured to be adjusted by (i) loosening or removing one or more fasteners that secure the second end of the respective actuator to the wall frame, (ii) moving the second end of the respective actuator to a different position on the wall frame, and (iii) tightening or replacing the one or more fasteners to secure the second end of the respective actuator to the wall frame.

4. The adjustable-incline climbing wall of claim 3, wherein moving the second end of the respective actuator to the different position on the wall frame comprises sliding the second end of the respective actuator along a portion of the wall frame.

5. The adjustable-incline climbing wall of claim 4, wherein one of the second end of the respective actuator and the wall frame comprises a slot and the other of the second end of the respective actuator and the wall frame comprises a projection that slides within the slot.

6. The adjustable-incline climbing wall of claim 2, wherein the connection between each of the one or more actuators and the wall frame is configured to be adjusted through an electronic control.

7. The adjustable-incline climbing wall of claim 1, wherein by combining the first permitted range of incline angles and the second permitted range of incline angles, the climbing surface is positionable at angles of incline between 0° and 55° relative to a vertical axis.

8. The adjustable-incline climbing wall of claim 7, wherein by combining the first permitted range of incline angles and the second permitted range of incline angles, the climbing surface is positionable at angles of incline between 0° and 60° relative to the vertical axis.

9. The adjustable-incline climbing wall of claim 8, wherein by combining the first permitted range of incline angles and the second permitted range of incline angles, the climbing surface is positionable at angles of incline between 0° and 65° relative to the vertical axis.

10. The adjustable-incline climbing wall of claim 1, wherein the fixed frame element supports the lower edge of the wall frame in a raised position relative to the ground surface on which the support assembly rests.

11. The adjustable-incline climbing wall of claim 10, wherein a top of the fixed frame element is at least twelve inches above the ground surface.

12. The adjustable-incline climbing wall of claim 11, in which the first end of each of the one or more actuators is at a greater height than the top of the fixed frame element.

13. The adjustable-incline climbing wall of claim 1, wherein the first permitted range of incline angles comprises angles between 0° and 55° relative to a vertical axis.

14. The adjustable-incline climbing wall of claim 13, wherein the second permitted range of incline angles comprises angles between 15° and 65° relative to the vertical axis.

15. The adjustable-incline climbing wall of claim 1, wherein the connection between the one or more actuators and one or more of (i) the wall frame and (ii) the actuator support frame is adjustable such that the one or more actuators is further movable to a third actuator attachment position; and wherein a third permitted range of incline angles is provided when the one or more actuators is in the third actuator attachment position, the third permitted range of incline angles being different from both the first permitted range of incline angles and the second permitted range of incline angles.

16. The adjustable-incline climbing wall of claim 15, wherein the first actuator attachment position is identified as providing incline angles having a first degree of difficulty, the second actuator attachment position is identified as providing incline angles having a second degree of difficulty, and the third actuator attachment position is identified as providing incline angles having a third degree of difficulty; and wherein each of the first, second, and third degree of difficulty differs from the others.

17. The adjustable-incline climbing wall of claim 1, wherein the one or more actuators comprises a plurality of actuators, each of the plurality of actuators having a first end connected to the actuator support frame and a second end connected to the wall frame;

wherein the connection between each of the plurality of actuators and one or more of (i) the wall frame and (ii) the actuator support frame is adjustable, such that each of the plurality of actuators is movable between the first actuator attachment position and the second actuator attachment position.

18. The adjustable-incline climbing wall of claim 17, wherein a first actuator of the plurality of actuators and a second actuator of the plurality of actuators are linked such that they are configured to be adjusted between the first actuator attachment position and the second actuator attachment position together.

19. The adjustable-incline climbing wall of claim 1, wherein the first actuator attachment position is identified as providing incline angles having a first degree of difficulty and the second actuator attachment position is identified as providing incline angles having a second degree of difficulty, the second degree of difficulty being different from the first degree of difficulty.

20. The adjustable-incline climbing wall of claim 1, wherein the one or more actuators is lockable in the first actuator attachment position to limit the incline of the climbing surface.

21. The adjustable-incline climbing wall of claim 1, wherein the connection between each of the one or more actuators and the actuator support frame is adjustable.

22. The adjustable-incline climbing wall of claim 1, wherein each of the one or more actuators is a pneumatic linear actuator, a hydraulic linear actuator, or an electric linear actuator.

23. The adjustable-incline climbing wall of claim 1, wherein the actuator support frame comprises at least first and second vertical members and a crossbar member.

24. The adjustable-incline climbing wall of claim 1, wherein the lower, fixed portion of the climbing surface comprises one or more climbing grips.

* * * * *